US011939128B2

(12) United States Patent
Ball et al.

(10) Patent No.: US 11,939,128 B2
(45) Date of Patent: Mar. 26, 2024

(54) CARTON AND BLANK THEREFOR

(71) Applicant: WestRock Packaging Systems, LLC, Atlanta, GA (US)

(72) Inventors: Nathaniel B. Ball, Richmond, VA (US); Meng-Chuan Wu, Fayetteville, GA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 230 days.

(21) Appl. No.: 17/420,679

(22) PCT Filed: Dec. 16, 2019

(86) PCT No.: PCT/US2019/066466

§ 371 (c)(1),
(2) Date: Jul. 5, 2021

(87) PCT Pub. No.: WO2020/142184

PCT Pub. Date: Jul. 9, 2020

(65) Prior Publication Data

US 2022/0097937 A1 Mar. 31, 2022

Related U.S. Application Data

(60) Provisional application No. 62/788,259, filed on Jan. 4, 2019.

(51) Int. Cl.
*B65D 71/34* (2006.01)
*B65D 71/36* (2006.01)

(52) U.S. Cl.
CPC ..... *B65D 71/34* (2013.01); *B65D 71/36* (2013.01); *B65D 2571/00141* (2013.01);
(Continued)

(58) Field of Classification Search
CPC ..... B65D 5/00; B65D 5/02; B65D 5/0227; B65D 5/029; B65D 71/34; B65D 71/36;
(Continued)

(56) References Cited

U.S. PATENT DOCUMENTS 4,216,861 A * 8/1980 Oliff ..... B65D 71/36 206/427
5,072,876 A * 12/1991 Wilson ..... B65D 71/36 206/427

(Continued)

FOREIGN PATENT DOCUMENTS

EP 0013479 A1 7/1980
EP 1138607 A1 10/2001

*Primary Examiner* — Bryon P Gehman
(74) *Attorney, Agent, or Firm* — Brian J. Goldberg; Rohini K. Garg

(57) ABSTRACT

Aspects of the disclosure relate to a package, a carton (190), and a blank (110) for forming the carton. An aspect of the invention provides a carton comprising a plurality of primary panels (112, 114, 116, 118, 120) defining an interior of the carton. The carton comprises a first panel (118) and a second panel (120) hinged to the first panel along a first fold line (119). The first panel has a first corner edge (55*a*) extending obliquely with respect to the first fold line such that an obtuse angle is defined between the first corner edge and the first fold line. The carton further comprises an opening feature (D) which is at least partially removable from the carton. The opening feature comprises a removable panel (170*a*) defined at least in part by first (173*a*) and second tear lines (173*b*) which define opposing side edges of the removable panel respectively.

19 Claims, 9 Drawing Sheets

(52) U.S. Cl.
CPC ..... *B65D 2571/0045* (2013.01); *B65D 2571/00549* (2013.01); *B65D 2571/00574* (2013.01); *B65D 2571/0066* (2013.01); *B65D 2571/00728* (2013.01)

(58) Field of Classification Search
CPC .. B65D 2571/00141; B65D 2571/0045; B65D 2571/00549; B65D 2571/00574; B65D 2571/0066; B65D 2571/00728
USPC ..... 206/427
See application file for complete search history.

(56) References Cited

U.S. PATENT DOCUMENTS

| | | | | |
|---|---|---|---|---|
| 7,367,453 | B2 * | 5/2008 | Sutherland | B65D 71/36 206/427 |
| 7,918,384 | B2 * | 4/2011 | Gomes | B65D 71/36 229/242 |
| 9,567,120 | B2 * | 2/2017 | Spivey, Sr. | B65D 71/36 |
| 2006/0065703 | A1 | 3/2006 | Debusk | |
| 2007/0095697 | A1 * | 5/2007 | Auclair | B65D 71/36 206/434 |
| 2018/0141734 | A1 * | 5/2018 | Kooc | B65D 5/4608 |

* cited by examiner

CARTON AND BLANK THEREFOR

TECHNICAL FIELD

The present invention relates to product packaging, to article carriers or cartons, and to blanks for forming the same. More specifically, but not exclusively, the invention relates to a carton having a dispensing feature for accessing the contents of the carton.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide a carton or article carrier having dispensing feature for accessing the contents of the carrier. It is desirable that the articles are retained within the interior of carton when the dispensing feature is deployed.

The present invention seeks to provide an improvement in the field of cartons and carton blanks, typically formed from paperboard or the like.

SUMMARY

A first aspect of the disclosure provides a carton for packaging one or more articles. The carton comprises a plurality of primary panels defining an interior of the carton. The carton comprises a first panel and a second panel hinged to the first panel along a first fold line. The first panel may have a first corner edge extending obliquely with respect to the first fold line such that an obtuse angle is defined between the first corner edge and the first fold lines. The carton further comprises an opening feature which is at least partially removable from the carton. The opening feature comprises a removable panel defined at least in part by first and second tear lines which define opposing side edges of the removable panel respectively. The first and second tear lines may each extend from the first fold line into the first panel. The first tear line may be located closer to the first corner edge than the second tear line. A first notional line may be interposed between the first and second tear lines such that the first notional line is disposed at a right angle with respect to the first fold line. A first angle is defined between the first notional line and the first corner edge, the first angle may be acute. A second angle is defined between the first notional line and at least part of the first tear line, the second angle may be acute. The first angle may be equal to or greater than the second angle.

Optionally, a third angle is defined between the first notional line and at least part of the second tear line, the third angle may be acute. The first angle may be equal to or greater than the third angle.

Optionally, the second angle is generally equal to the third angle.

Optionally, the first panel has a second corner edge extending obliquely with respect to the first fold line such that an obtuse angle may be defined between the second corner edge and the first fold lines. The removable panel may disposed between the first and second corner edges. A fourth angle is defined between the first notional line and the second corner edge, the fourth angle may be acute. A third angle is defined between the first notional line and at least part of the second tear line, the third angle may be acute. The fourth angle may be equal to or greater than the third angle.

Optionally, the first and second tear lines each extends across the first fold line into the second panel.

Optionally, the opening feature further comprises a tear initiation feature defined in the second panel and wherein the first and second tear lines may each extends from the tear initiation feature.

Optionally, the carton comprises a group of generally cylindrical articles each having an end and a cylindrical axis. The group of articles is received in an interior of the carton such that cylindrical axes of the articles may extend generally perpendicularly to a plane of the first panel. The group of articles may be arranged in a plurality of rows of articles comprising a first row and a second row. The first row may extend along the second panel. The first row may be in rolling contact with the second panel. The second row may be disposed along the first row such that the articles of the second row may be nested with the articles of the first row. A second notional line extends between a centre of the end of one of the articles in the first row and a centre of the end of an adjacent one of the articles in the second row. A fifth angle is defined between the second notional line and the first notional line. The fifth angle may be generally equal to the second angle.

Optionally, the fifth angle is generally equal to the third angle.

A second aspect of the disclosure provides a carton for packaging one or more articles. The carton comprises a plurality of main or primary panels defining an interior of the carton including a first panel and a second panel hinged to the first panel along a first fold line. The first panel may have a first corner edge extending obliquely with respect to the first fold line such that a first angle is defined between the first corner edge and the first fold line, the first angle may be obtuse. The carton comprises an opening feature which may be at least partially removable from the carton. The opening feature may comprise a removable panel defined at least in part by first and second tear lines which define opposing side edges of the removable panel respectively. The first and second tear lines may each extend from the first fold line into the first panel. The first tear line may be located closer to the first corner edge than the second tear line. A first notional line may be interposed between the first and second tear lines such that the first notional line is disposed at a right angle with respect to the first fold line. A second angle is defined between the first notional line and at least part of the first tear line, the second angle may be acute. The carton may comprise a group of generally cylindrical articles each having an end and a cylindrical axis. The group of articles is received in an interior of the carton such that cylindrical axes of the articles may extend generally perpendicularly to a plane of the first panel. The group of articles may be arranged in a plurality of rows of articles comprising a first row and a second row. The first row may extend along the second panel. The second row may be disposed along the first row such that the articles of the second row may be nested with the articles of the first row. A second notional line extends between a centre of the end of one of the articles in the first row and a centre of the end of an adjacent one of the articles in the second row. A third angle is defined between the second notional line and a first notional line. The third angle may be generally equal to a second angle.

Optionally, a fourth angle is defined between the first notional line and at least part of the second tear line, the fourth angle may be acute. The third angle may be generally equal to the fourth, angle.

A third aspect of the disclosure provides a blank for forming a carton. The blank comprises a plurality of primary panels for defining an interior of the carton. The plurality of panels comprises a first panel and a second panel hinged to the first panel along a first fold line. The first panel may have a first corner edge extending obliquely with respect to the first fold line such that an obtuse angle is defined between the first corner edge and the first fold lines. The blank may comprise an opening feature which is at least partially removable from the carton. The opening feature may comprise a removable panel defined at least in part by first and second tear lines which may define opposing side edges of the removable panel respectively. The first and second tear lines may each extend from the first fold line into the first panel. The first tear line may be located closer to the first corner edge than the second tear line. A first notional line may be interposed between the first and second tear lines such that the first notional line is disposed at a right angle with respect to the first fold line. A first angle is defined between the first notional line and the first corner edge, the first angle may be acute. A second angle is defined between the first notional line and at least part of the first tear line, the second angle may be acute. The first angle may be equal to or greater than the second angle.

A fourth aspect of the disclosure provides a blank for forming a carton. The blank comprises a plurality of primary panels for defining an interior of the carton. The plurality of panels comprises a first panel and a second panel hinged to the first panel along a first fold line. The first panel may have a first corner edge extending obliquely with respect to the first fold line such that a first angle is defined between the first corner edge and the first fold lines, the first angle may be obtuse. The blank may comprise an opening feature which is at least partially removable from the carton. The opening feature may comprise a removable panel defined at least in part by first and second tear lines which may define opposing side edges of the removable panel respectively. The first and second tear lines may each extend from the first fold line into the first panel. The first tear line may be located closer to the first corner edge than the second tear line. A first notional line may be interposed between the first and second tear lines such that the first notional line is disposed at a right angle with respect to the first fold line. A second angle is defined between the first notional line and at least part of the first tear line, the second angle may be acute. The blank may be arranged to accommodate a group of generally cylindrical articles each having an end and a cylindrical axis, the group of articles when received in an interior of a setup carton may be oriented such that the cylindrical axes of the articles extend generally perpendicularly to a plane of the first panel. The group of articles may arranged in a plurality of rows of articles comprising a first row and a second row. The first row may extend along the second panel. The second row may be disposed along the first row such that the articles of the second row may be nested with the articles of the first row. A second notional line extends between a centre of the end of one of the articles in the first row and a centre of the end of an adjacent one of the articles in the second row. A third angle is defined between the second notional line and a first notional line. The third angle may be generally equal to a second angle.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, carton and blank are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, cartons and blanks described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
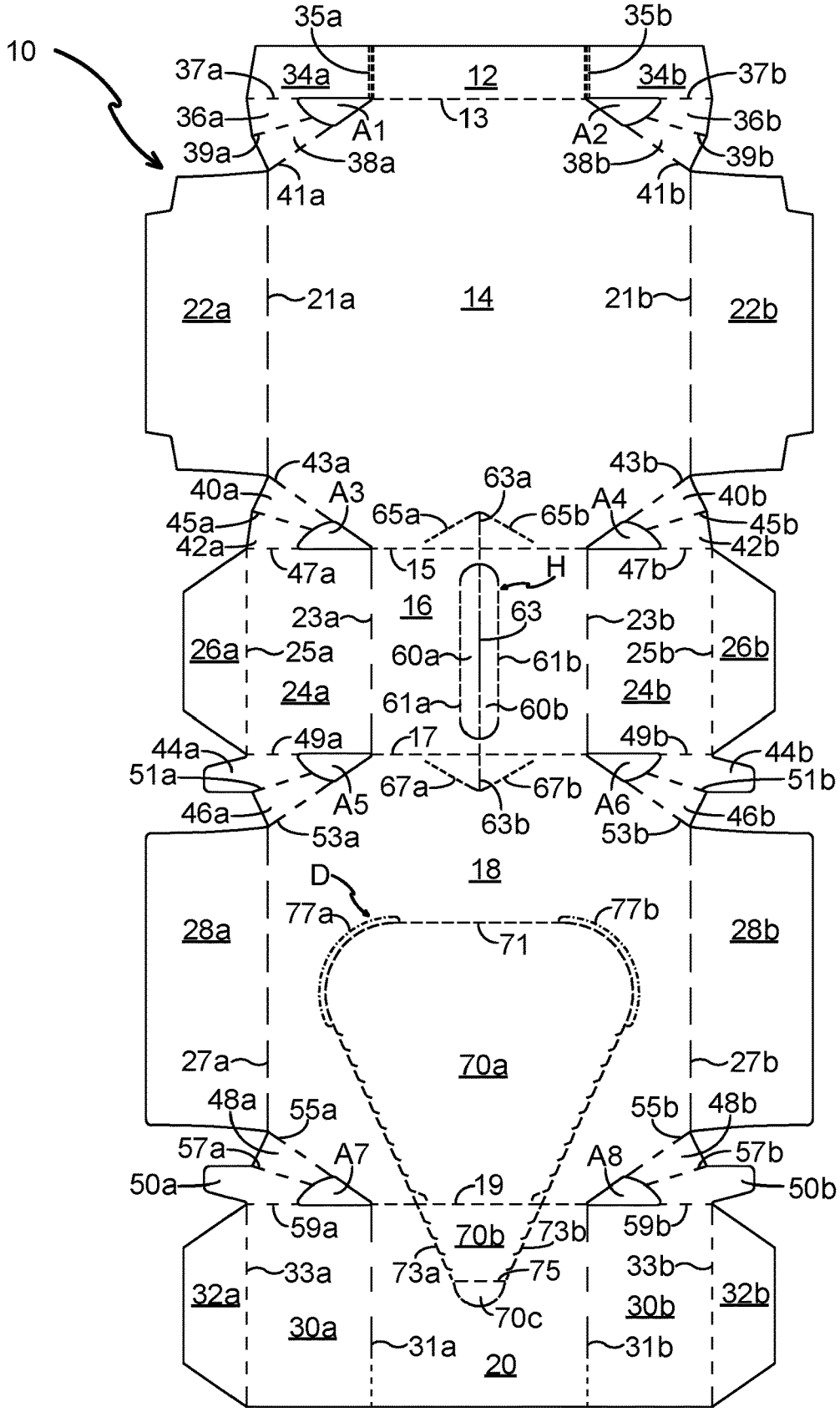
FIG. 1 is a plan view from above of a blank for forming an article carrier according to a first embodiment.
Figure 2:
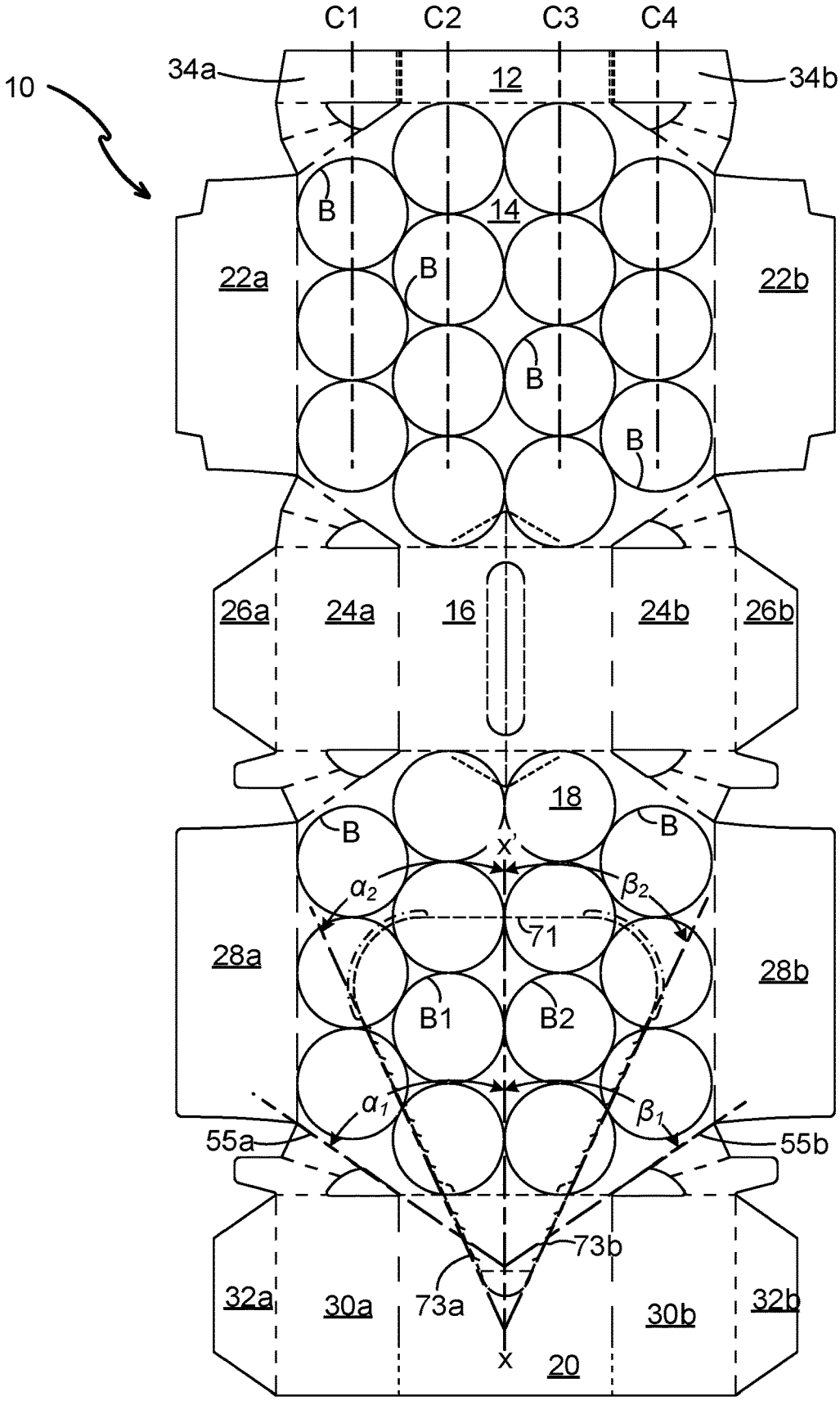
FIG. 2 is a plan view from above of the blank of FIG. 1 showing the arrangement of a plurality of articles with respect to top and bottom panels of the blank.
Figure 3:
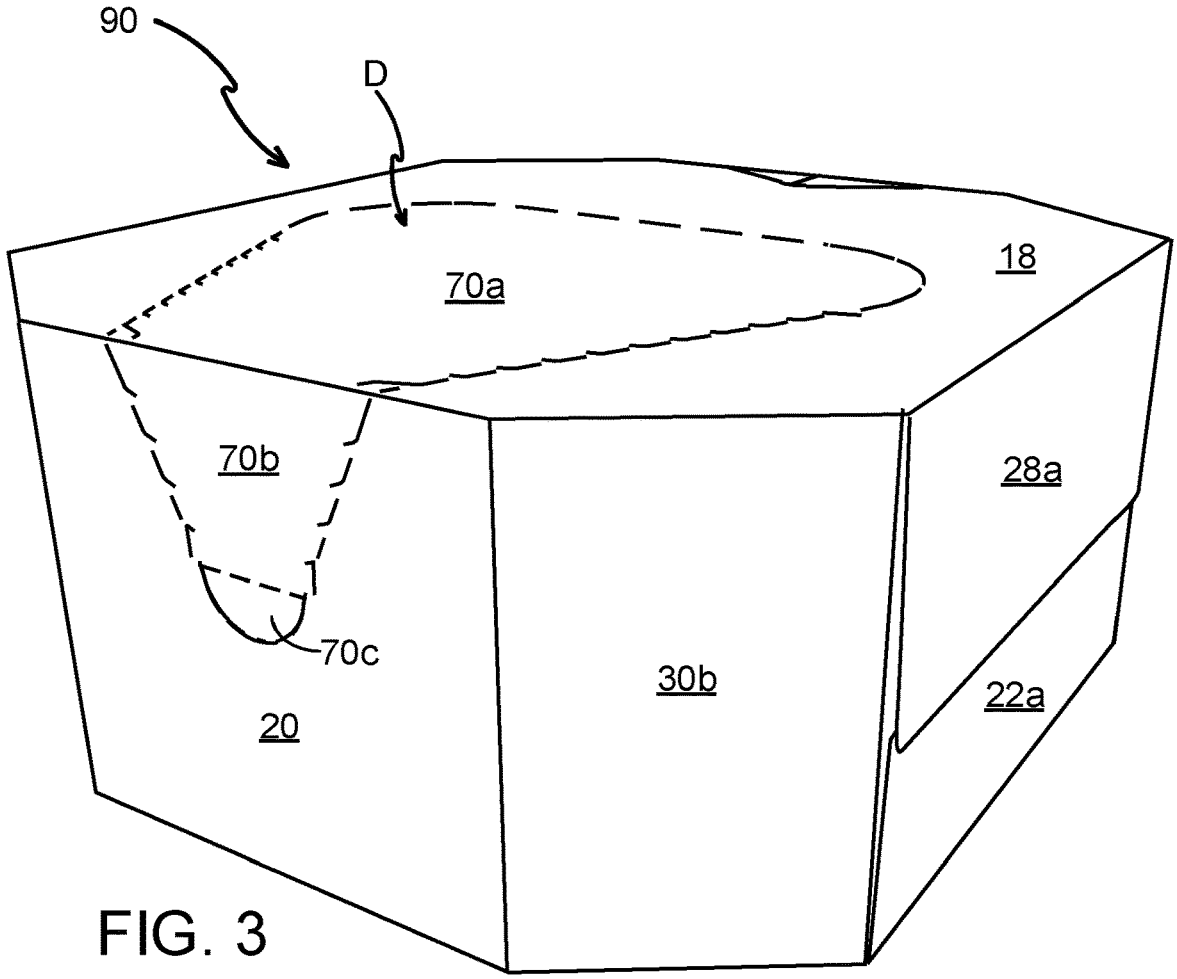
FIG. 3 is a perspective view of an article carrier formed from the blank of FIG. 1.

Referring to FIGS. 1 and 2, there is shown plan views of a blank 10, according to an embodiment of the disclosure, capable of forming a package in the form of an article carrier or carton 90, as shown in FIG. 3, for containing and carrying a group of primary products such as, but not limited to, cans, hereinafter referred to as articles B.

Figure 4:
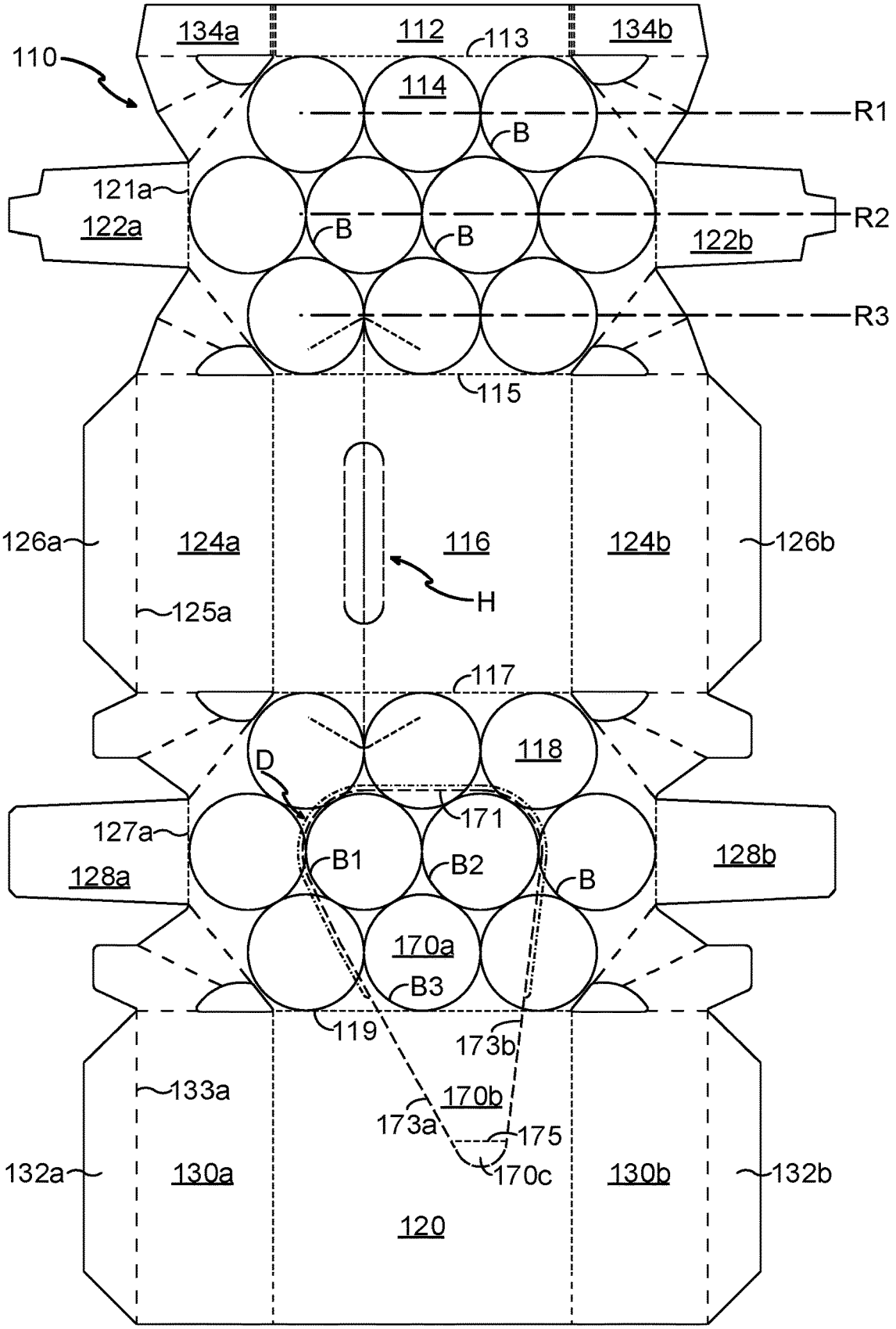
FIG. 4 is a plan view from above of a blank for forming an article carrier according to a second embodiment and showing an arrangement of a plurality of articles with respect to top and bottom panels of the blank.
Figure 5:
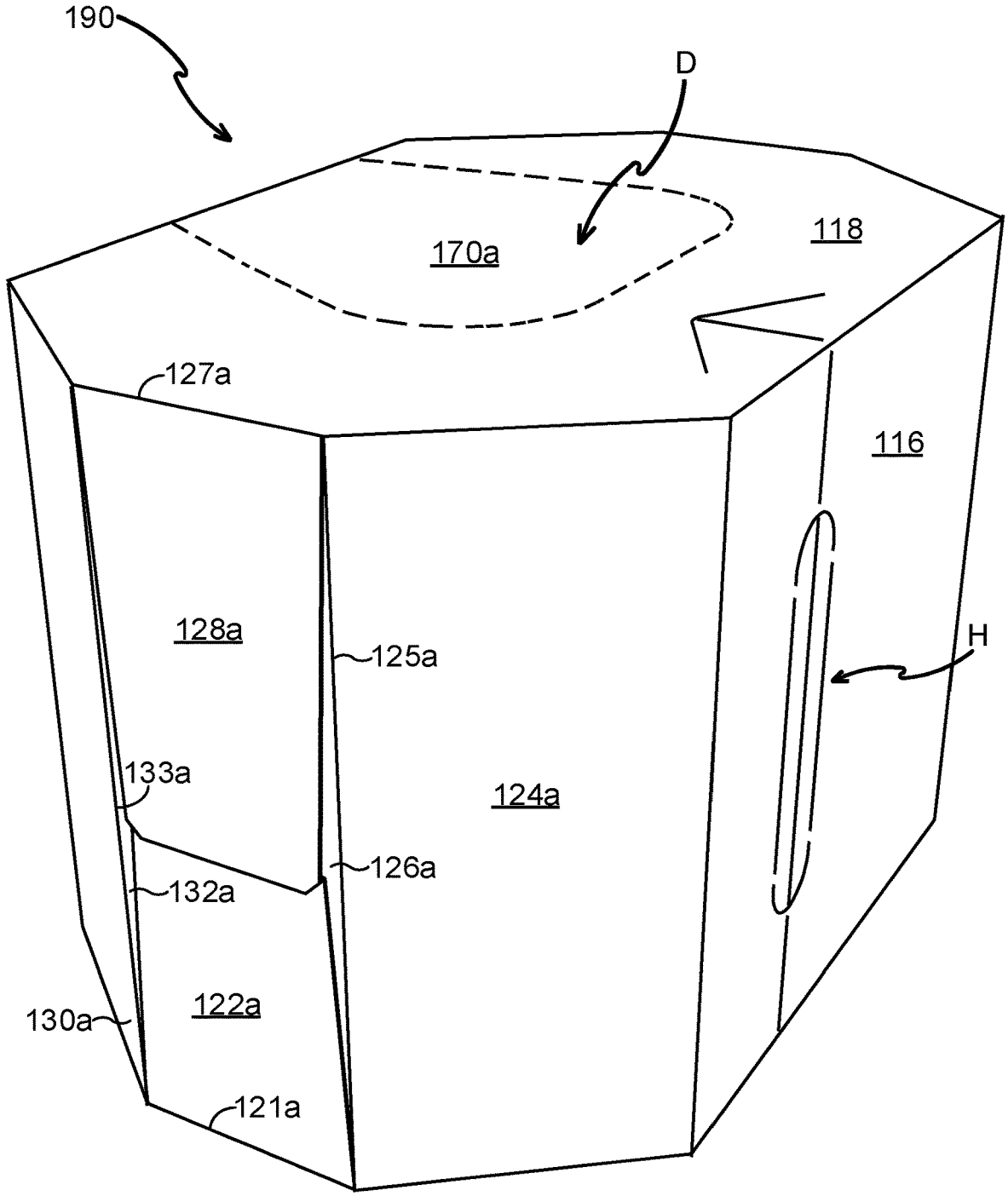
FIG. 5 is a perspective view of an article carrier formed from the blank of FIG. 4.

FIG. 4 shows a plan view of a blank 110, according to another embodiment of the disclosure, capable of forming an article carrier or carton 190, as shown in FIG. 5.

Figure 6:
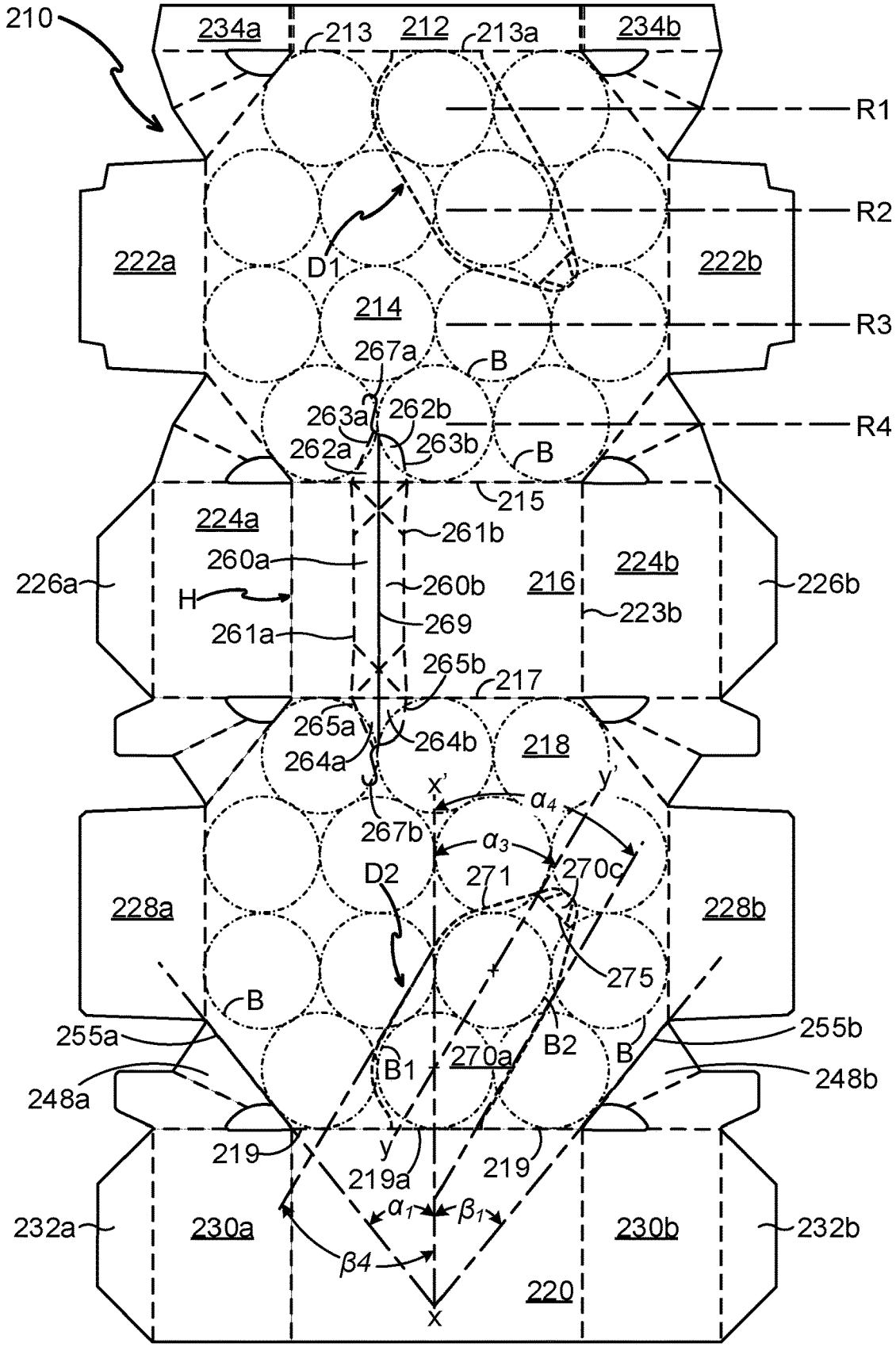
FIG. 6 is a plan view from above of a blank for forming an article carrier according to a third embodiment and showing an arrangement of a plurality of articles with respect to top and bottom panels of the blank.
Figure 7:
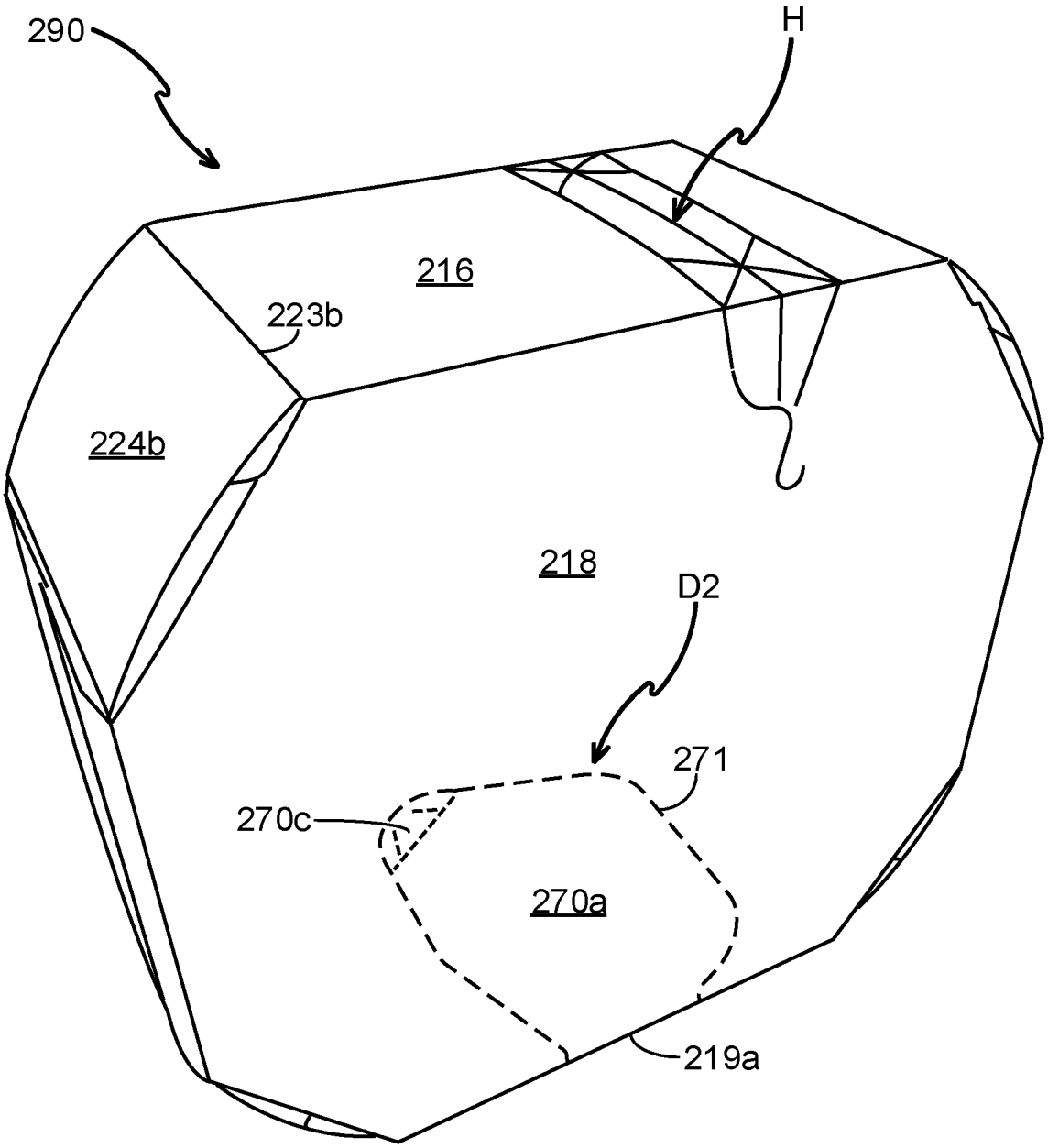
FIG. 7 is a perspective view of an article carrier formed from the blank of FIG. 6.
Figure 8A:
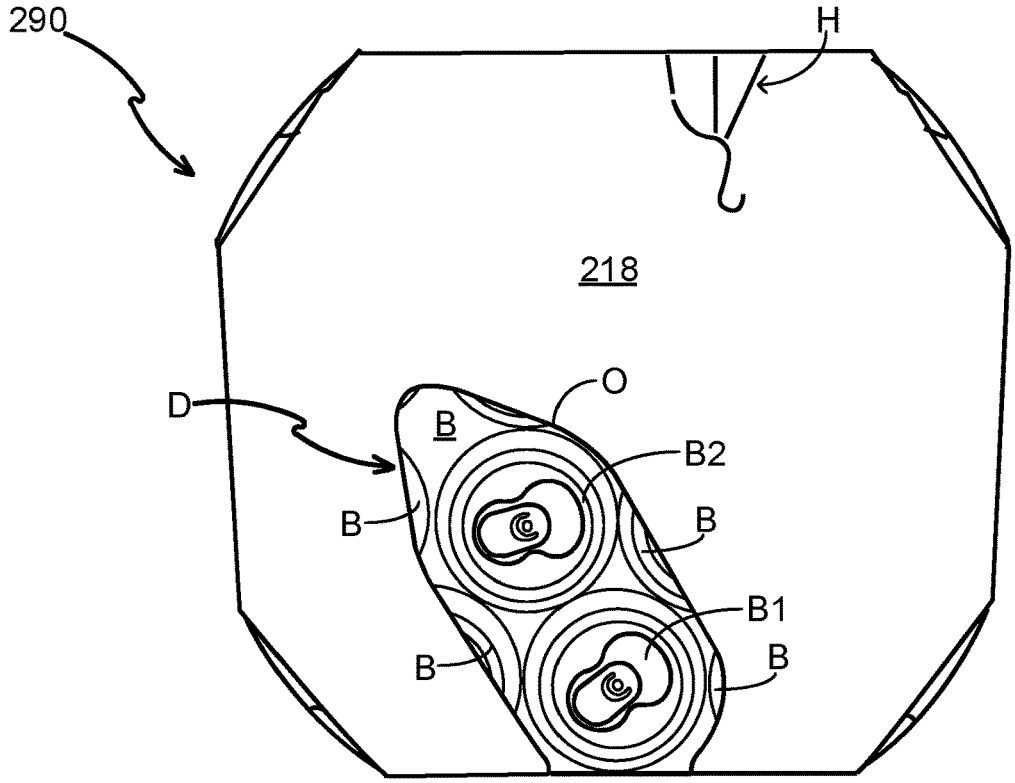
FIGS. 8A and 8B illustrate the article carrier of FIG. 7 in which a dispensing or access feature is in a deployed condition.
Figure 8B:
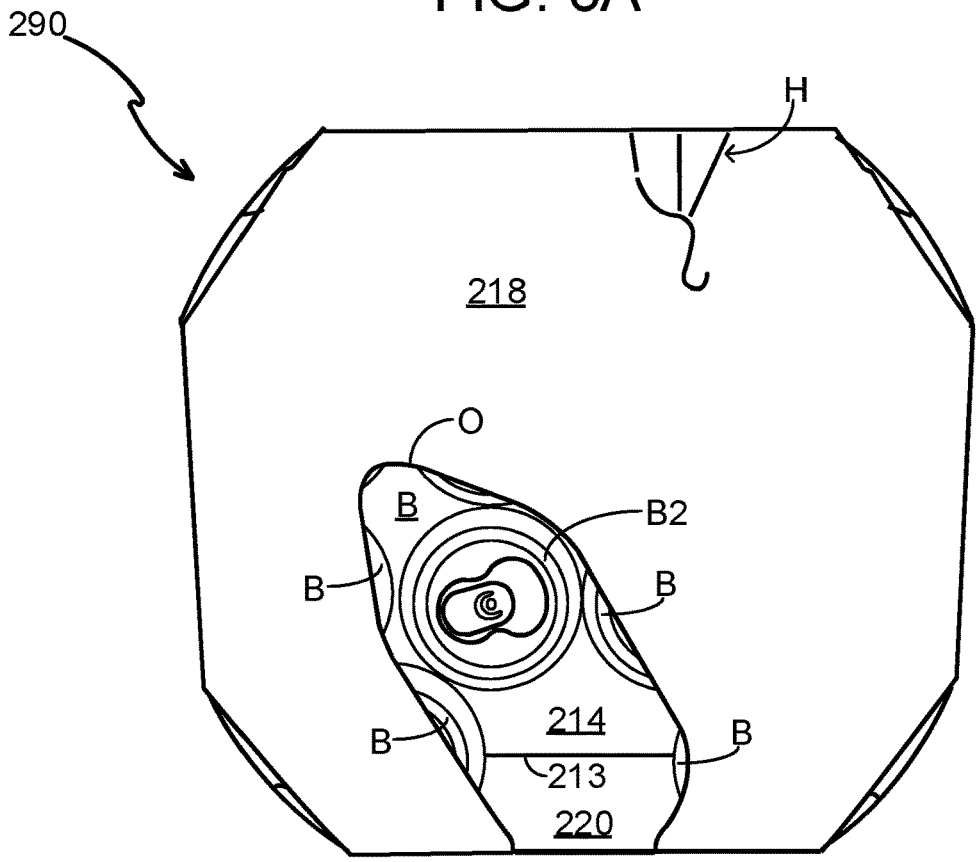

FIG. 6 shows a plan view of a blank 210, according to yet another embodiment of the disclosure, capable of forming an article carrier or carton 290, as shown in FIGS. 7, 8A and 8B.

Figure 9:
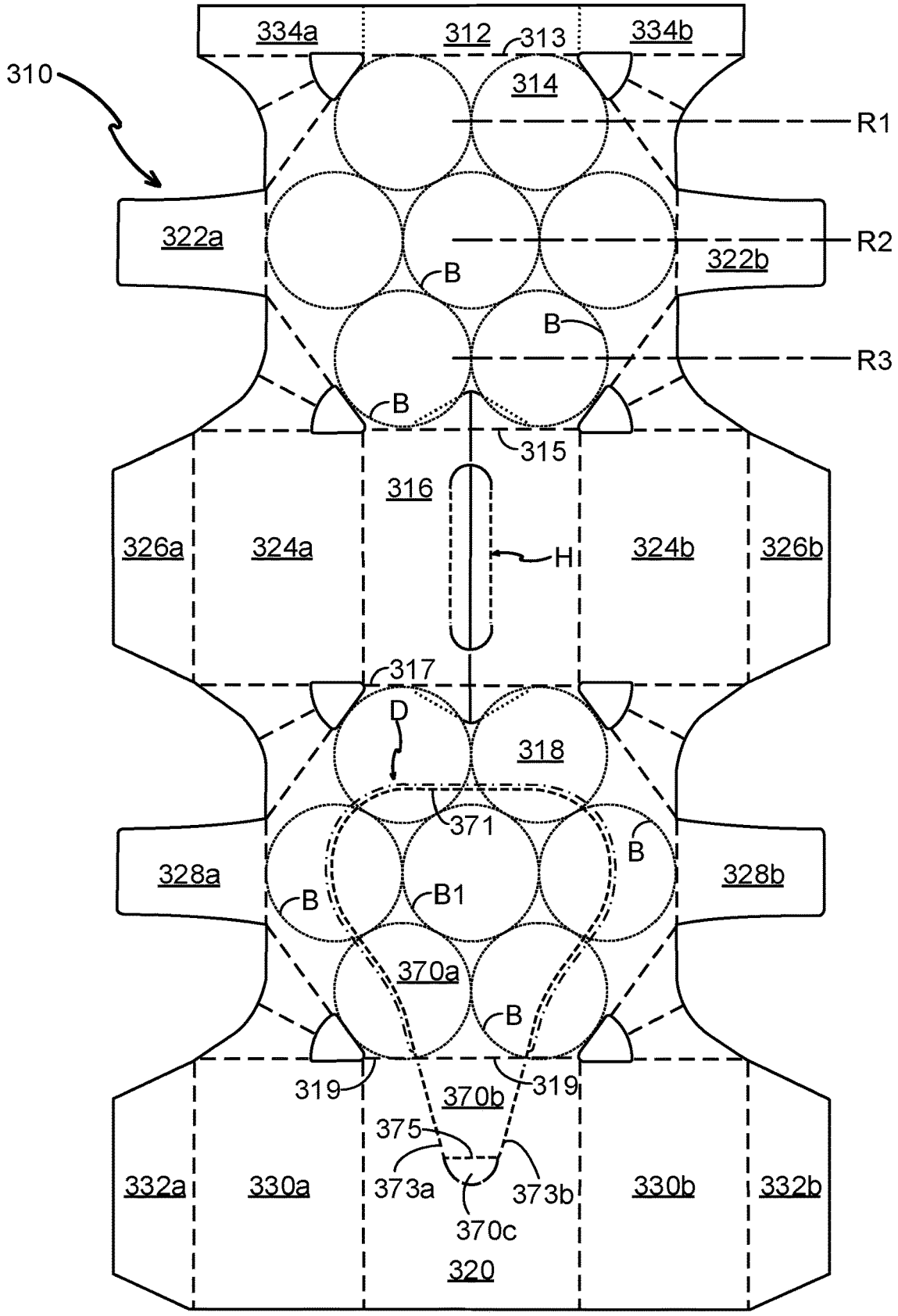
FIG. 9 is a plan view from above of a blank for forming an article carrier according to a fourth embodiment and showing an arrangement of a plurality of articles with respect to top and bottom panels of the blank.

FIG. 9 shows a plan view of a blank 310, according to still another embodiment of the disclosure, capable of forming an article carrier or carton (not shown).

In the embodiments detailed herein, the terms "carton" and "carrier" refer, for the non-limiting purpose of illustrating the various features of the invention, to a container 90, 190, 290 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blanks 10, 110, 210, 310 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The cartons 90, 190, 290 described and/or illustrated herein may be formed from a sheet material such as paperboard, which may be made of or coated with materials to increase strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or otherwise be prepared to provide properties such as one or more of tear-resistance, good glue-ability, heat sealability, or other desired functional properties.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low density polyethylene (LDPE). The adhesive layer may be placed between the substrate and the tear resistant layer to secure the tear resistant layer to the substrate.

In the embodiment illustrated in FIGS. 1 and 2, the blank 10 is configured to form a carton or carrier 90 for packaging an exemplary arrangement of exemplary articles B. In the illustrated embodiment the arrangement is a nested arrangement of articles, having four columns C1, C2, C3, C4.

The outermost (endmost) columns C1, C4 each comprise three articles; the inner columns C2, C3 each comprise four articles, as shown in FIG. 2. The centres (tubular axes) of the articles in the outer columns C1, C4 are offset with respect to the centres (tubular axes) of the articles in the adjacent inner column C2, C3. In this way an article in an outer column C1, C4 may be nested between a pair of articles in the adjacent inner column C2, C3, that is to say located in a void between said pair of articles.

The centre (tubular axes) of an article in one of the inner columns C2, C3 may be substantially aligned, so as to be in vertical registry in normal dispensing use, with the centres (tubular axes) of the other articles in said column C2, C3.

The centre (tubular axes) of an article in one of the outer columns C1, C4 may be substantially aligned with the centres (tubular axes) of the other articles in that column C1, C4.

The centre of an article B in a first outer column C1 and the centre of an opposing article B in a second outer column C4 define a notional line therebetween. The notional line is disposed tangentially to each of a pair of articles in each of the inner columns C2, C3. Each of the aforesaid articles in the outer columns C1, C4 may be in touching contact with each of a pair of articles in the adjacent inner column C2, C3. Each article may be in touching contact with at least one adjacent article.

The articles B are cans, the illustrated example comprises 7.5 US fl. oz. (221 ml) beverage "mini" cans, the cans may be formed from a suitable material such as, but not limited to, Aluminium. Alternatively, the blank 10 can be configured to form a carrier for packaging other types, number and size of articles B and/or for packaging articles B in a different arrangement or configuration for example, but not limited to, the articles B may be bottles, cups, pouches or pots.

In the embodiment illustrated in FIGS. 4 and 5, the blank 110 is configured to form a carton or carrier 190 for packaging an exemplary arrangement of exemplary articles B. In the illustrated embodiment the arrangement is a nested arrangement of articles, having three rows R1, R2, R3, the central or middle row R2 comprises four articles, the outer (upper and lower) rows R3, R1 each comprise three articles.

The centres (tubular axes) of the articles in the outer rows R1, R3 are offset with respect to the centres (tubular axes) of the articles in the centre row R2. The centre (tubular axes) of an article in one of the outer rows R1, R3 may be substantially aligned with the centre (tubular axes) of an article in the other one of the outer rows R1, R3; the centres of said articles define a notional line. The notional line is disposed tangentially to each of a pair of articles in the centre row R2. Each of the aforesaid articles in the outer rows R1, R3 may be in touching contact with each of the pair of articles in the centre row R2; the pair of articles in the centre row R2 may be in touching contact with each other. The articles B are cans, the illustrated example comprises 12 US fl. oz. (355 ml) beverage cans, the cans may be formed from a suitable material such as, but not limited to, Aluminium. Alternatively, the blank 110 can be configured to form a carrier for packaging other types, number and size of articles B and/or for packaging articles B in a different arrangement or configuration for example, but not limited to, the articles B may be bottles, cups, pouches or pots.

In the embodiment illustrated in FIGS. 6 and 7, the blank 210 is configured to form a carton or carrier 290 for packaging an exemplary arrangement of exemplary articles B. In the illustrated embodiment the arrangement comprises four rows R1, R2, R3, R4. The outermost (upper and lower) rows R4, R1 each comprise three articles, the inner rows R2, R3 each comprise four articles, best shown in FIG. 6. The centres (tubular axes) of the articles in the outer rows R1, R4 are offset with respect to the centres (tubular axes) of the articles in the adjacent inner row R2, R3. In this way an article in an outer row R1, R4 may be nested between a pair of articles in the adjacent inner row R2, R3, that is to say located in a void between said pair of articles.

The centre (tubular axes) of an article in one of the inner rows R2, R3 may be substantially aligned, so as to be in vertical registry in normal dispensing use, with the centre (tubular axes) of an article in the other one of the inner rows R2, R3.

The centre (tubular axes) of an article in one of the outer rows R1, R4 may be substantially aligned with the centre (tubular axes) of an article in the other one of the outer rows R1, R4. The centres of said articles define a notional line the notional line is disposed tangentially to each of a pair of articles in each of the inner rows R2, R3. Each of the aforesaid articles in the outer rows R1, R4 may be in touching contact with each of a pair of articles in the adjacent inner row R2, R3. Each article may be in touching contact with at least one adjacent article.

The articles B are cans, the illustrated example comprises 12 US fl. oz. (355 ml) beverage cans, the cans may be formed from a suitable material such as, but not limited to, Aluminium. Alternatively, the blank 210 can be configured to form a carrier for packaging other types, number and size of articles B and/or for packaging articles B in a different arrangement or configuration for example, but not limited to, the articles B may be bottles, cups, pouches or pots.

In the embodiment illustrated in FIG. 9, the blank 310 is configured to form a carton or carrier (not shown) for packaging an exemplary arrangement of exemplary articles B. In the illustrated embodiment the arrangement is a nested arrangement of articles, having three rows R1, R2, R3, the central row R2 comprises three articles, the outer (upper and lower) rows R3, R1 each comprise two articles. The centres (tubular axes) of the articles B in the outer rows R1, R3 are offset with respect to the centres (tubular axes) of the articles B in the centre row R2. The centre (tubular axes) of an article B in one of the outer rows R1, R3 may be substantially aligned with the centre (tubular axes) of an article B in the other one of the outer rows R1, R3; the centres of said articles B define a notional line the notional line is disposed tangentially to each of a pair of articles B in the centre row R2. Each of the aforesaid articles B in the outer rows R1, R3 may be in touching contact with each of the pair of articles B in the centre row R2; the pair of articles B in the centre row R2 may be in touching contact with each other. The articles B are cans, the illustrated example comprises 12 US fl. oz. (355 ml) beverage cans, the cans may be formed from a suitable material such as, but not limited to, Aluminium. Alternatively, the blank 310 can be configured to form a carrier for packaging other types, number and size of articles B and/or for packaging articles B in a different arrangement or configuration for example, but not limited to, the articles B may be bottles, cups, pouches or pots.

Turning to FIG. 1, there is illustrated a blank 10 for forming a carton 90 (see FIGS. 3 and 3B) according to a first embodiment. The blank 10 comprises a plurality of main or primary panels 12, 14, 16, 18, 20 for forming a tubular structure. The plurality of main panels 12, 14, 16, 18, 20 comprises a securing flap 12, a first side panel 14, a top panel 16, a second side panel 18, and a base panel 20. The plurality of main panels 12, 14, 16, 18, 20 may be hingedly connected to each other, one to the next, in a linear series by a respective one of a plurality of hinged connections in the form of fold lines 13, 15, 17, 19.

Figure 3B:
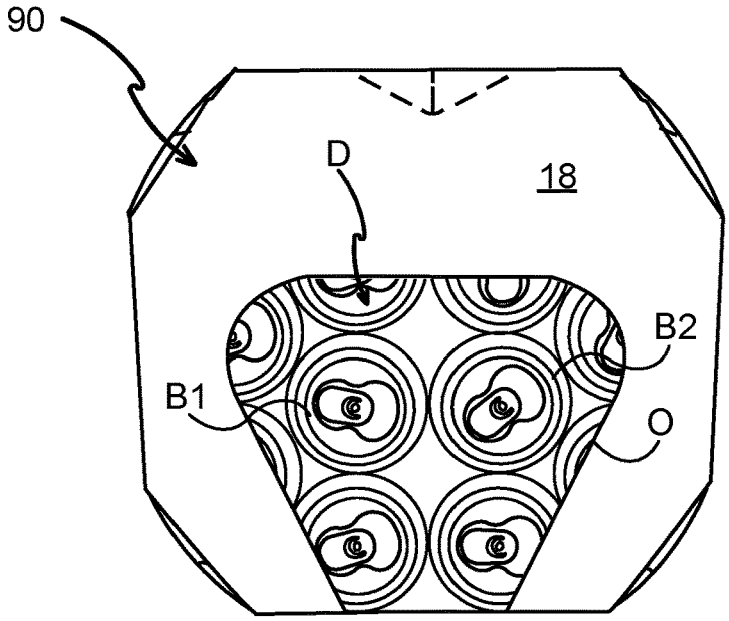
FIG. 3B illustrates the article carrier of FIG. 3 in which a dispensing or access feature is in a deployed condition.

The panels of the blank 10 are described with reference to a dispensing feature D which in use, as shown in FIG. 3B, is provided in part in a first panel 18 forming a side wall or side panel of the carton 90 and is provided in part in a second, adjacently disposed, panel 20 forming a base wall or panel of the carton 90, see FIG. 3. The carton 90 may also comprise a handle structure H, the handle structure H may be provided at least in part in a third panel 16. The third panel 16 may be arranged to oppose the second panel 20. The third panel 16, when the handle structure is in use, forms a top wall of the carton 90. When the blank 10 is erected to form an open ended tubular structure for loading with articles B, each of the first and second side panels 14, 18 forms one of a top and base wall; in the loading orientation the dispensing feature D, shown in FIG. 3, is in a side wall of the carrier 90.

The first side panel 14 and the second side panel 18 are octagonal in shape. The blank 10 comprises a plurality of major corner or bevel panels 24*a*, 24*b*, 30*a*, 30*b* which partially close ends of the tubular structure defined by plurality of primary panels 12, 14, 16, 18, 20.

The blank 10 comprises a first major corner panel 24*a* hingedly connected to a first end of the top panel 16 by a hinged connection in the form of a fold line 23*a*. The blank 10 comprises a second major corner panel 24*b* hingedly connected to a second end of the top panel 16 by a hinged connection in the form of a fold line 23*b*.

The blank 10 comprises a third major corner panel 30*a* hingedly connected to a first end of the base panel 20 by a hinged connection in the form of a fold line 31*a*. The blank 10 comprises a fourth major corner panel 30*b* hingedly connected to a second end of the base panel 20 by a hinged connection in the form of a fold line 31*b*.

The blank 10 comprises end closure structures for completing closure of the open ends of the tubular structure.

A first end closure structure comprises; a first side end closure panel 22*a* hingedly connected to a first end of the first side panel 14 by a hinged connection in the form of a fold line 21*a*, a second side end closure panel 28*a* hingedly connected to a first end of the second side panel 18 by a hinged connection in the form of a fold line 27*a*, a first top end closure panel 26*a* hingedly connected to the first major corner panel 24*a* by a hinged connection in the form of a fold line 25*a*, and a first base end closure panel 32*a* hingedly connected to the third major corner panel 30*a* by a hinged connection in the form of a fold line 33*a*.

A second end closure structure comprises; a third side end closure panel 22*b* hingedly connected to a second end of the first side panel 14 by a hinged connection in the form of a fold line 21*b*, a fourth side end closure panel 28*b* hingedly connected to a second end of the second side panel 18 by a hinged connection in the form of a fold line 27*b*, a second top end closure panel 26*b* hingedly connected to the second major corner panel 24*b* by a hinged connection in the form of a fold line 25*b*, and a second base end closure panel 32*b* hingedly connected to the fourth major corner panel 30*b* by a hinged connection in the form of a fold line 33*b*.

A first securing tab 34*a* is hingedly connected to a first end of the securing flap 12 by a hinged connection in the form of a fold line 35*a*. A second securing tab 34*b* is hingedly connected to a second end of the securing flap 12 by a hinged connection in the form of a fold line 35*b*.

The first securing tab 34*a* is hingedly connected to the first side panel 14 by a first pair of web panels 36*a*, 38*a*, also referred to herein as minor corner panels. The first pair of web panels 36*a*, 38*a* is hinged to a first bevelled or chamfered corner of the first side panel 14. The first pair of web panels 36*a*, 38*a* underlies the third major corner panel 30*a* in a setup condition. A first web panel 36*a* is hingedly connected to the first securing tab 34*a* by a hinged connection in the form of a fold line 37*a*. A second web panel 38*a* is hingedly connected to the first web panel 36*a* by a hinged connection in the form of a fold line 39*a*. The second web panel 38*a* is hingedly connected to the first side panel 14 by a hinged connection in the form of a fold line 41*a*.

The fold line 37*a* is substantially collinear with the fold line 13.

Each of the first pair of web panels 36*a*, 38*a* is defined in part by a pair of divergently arranged fold lines 37*a*/39*a*, 39*a*/41*a*.

The blank 10 comprises a first aperture A1 struck from the first pair of web panels 36*a*, 38*a* so as to interrupt the fold lines 37*a*, 39*a*, 41*a*. The first aperture A1 is located at a position at which the fold lines 37*a*, 39*a*, 41*a* would intersect with each other and with the fold lines 13 and 35*a*.

The second securing tab 34*b* is hingedly connected to the first side panel 14 by a second pair of web panels 36*b*, 38*b*, also referred to herein as minor corner panels. The second pair of web panels 36*b*, 38*b* is hinged to a second bevelled or chamfered corner of the first side panel 14. The second pair of web panels 36*b*, 38*b* underlies the fourth major corner panel 30*b* in a setup condition. A third web panel 36*b* is hingedly connected to the second securing tab 34*b* by a hinged connection in the form of a fold line 37*b*. A fourth web panel 38*b* is hingedly connected to the third web panel 36*b* by a hinged connection in the form of a fold line 39*b*. The fourth web panel 38*b* is hingedly connected to the first side panel 14 by a hinged connection in the form of a fold line 41*b*.

The fold line 37*b* is substantially collinear with the fold line 13.

Each of the second pair of web panels 36*b*, 38*b* is defined in part by a pair of divergently arranged fold lines 37*b*/39*b*, 39*b*/41*b*.

The blank 10 comprises a second aperture A2 struck from the second pair of web panels 36*b*, 38*b* so as to interrupt the fold lines 37*b*, 39*b*, 41*b*. The second aperture A2 is located at a position at which the fold lines 37*b*, 39*b*, 41*b* would intersect with each other and with the fold lines 13 and 35*b*.

The first major corner panel 24*a* is hingedly connected to the first side panel 14 by a third pair of web panels 40*a*, 42*a*, also referred to herein as minor corner panels. The third pair of web panels 40*a*, 42*a* is hinged to a third bevelled or chamfered corner of the first side panel 14. The third pair of web panels 40*a*, 42*a* underlies the first major corner panel 24*a* in a setup condition. A fifth web panel 40*a* is hingedly connected to the first side panel 14 by a hinged connection in the form of a fold line 43*a*. A sixth web panel 42*a* is hingedly connected to the fifth web panel 40*a* by a hinged connection in the form of a fold line 45*a*. The sixth web panel 42*a* is hingedly connected to the first major corner panel 24*a* by a hinged connection in the form of a fold line 47*a*.

The fold line 47*a* is substantially collinear with the fold line 15.

Each of the third pair of web panels 40*a*, 42*a* is defined in part by a pair of divergently arranged fold lines 43*a*/45*a*, 45*a*/47*a*.

The blank 10 comprises a third aperture A3 struck from the third pair of web panels 40*a*, 42*a* so as to interrupt the fold lines 43*a*, 45*a*, 47*a*. The third aperture A3 is located at a position at which the fold lines 43*a*, 45*a*, 47*a* would intersect with each other and with the fold lines 15 and 23*a*.

The second major corner panel 24*b* is hingedly connected to the first side panel 14 by a fourth pair of web panels 40*b*, 42*b* also referred to herein as minor corner panels. The fourth pair of web panels 40*b*, 42*b* is hinged to a third bevelled or chamfered corner of the first side panel 14, The fourth pair of web panels 40*b*, 42*b* underlies the second major corner panel 24*b* in a setup condition. A seventh web panel 40*b* is hingedly connected to the first side panel 14 by a hinged connection in the form of a fold line 43*b*. An eighth web panel 42*b* is hingedly connected to the seventh web panel 40*b* by a hinged connection in the form of a fold line 45*b*. The eighth web panel 42*b* is hingedly connected to the second major corner panel 24*b* by a hinged connection in the form of a fold line 47*b*.

The fold line 47*b* is substantially collinear with the fold line 15.

Each of the fourth pair of web panels 40*b*, 42*b* is defined in part by a pair of divergently arranged fold lines 43*b*/45*b*, 45*b*/47*b*.

The blank 10 comprises a fourth aperture A4 struck from the fourth pair of web panels 40*b*, 42*b* so as to interrupt the fold lines 43*b*, 45*b*, 47*b*. The fourth aperture A4 is located at a position at which the fold lines 43*b*, 45*b*, 47*b* would intersect with each other and with the fold lines 15 and 23*b*.

The first major corner panel 24*a* is hingedly connected to the second side panel 18 by a fifth pair of web panels 44*a*, 46*a*, also referred to herein as minor corner panels. The fifth pair of web panels 44*a*, 46*a* is hinged to a first bevelled or chamfered corner of the second side panel 18. The fifth pair of web panels 44*a*, 46*a* underlies the first major corner panel 24*a* in a setup condition. A ninth web panel 44*a* is hingedly connected to the first major corner panel 24*a* by a hinged connection in the form of a fold line 49*a*. A tenth web panel 46*a* is hingedly connected to the ninth web panel 44*a* by a hinged connection in the form of a fold line 51*a*. The tenth web panel 46*a* is hingedly connected to the second side panel 18 by a hinged connection in the form of a fold line 53*a*.

The fold line 49*a* is substantially collinear with the fold line 17.

Each of the fifth pair of web panels 44*a*, 46*a* is defined in part by a pair of divergently arranged fold lines 49*a*/51*a*, 51*a*/53*a*.

The blank 10 comprises a fifth aperture A5 struck from the fifth pair of web panels 44*a*, 46*a* so as to interrupt the fold lines 49*a*, 51*a*, 53*a*. The fifth aperture A5 is located at a position at which the fold lines 49*a*, 51*a*, 53*a* would intersect with each other and with the fold lines 17 and 23*a*.

The second major corner panel 24*b* is hingedly connected to the second side panel 18 by a sixth pair of web panels 44*b*, 46*b*, also referred to herein as minor corner panels. The sixth pair of web panels 44*b*, 46*b* is hinged to a second bevelled or chamfered corner of the second side panel 18. The sixth pair of web panels 44*b*, 46*b* underlies the second major corner panel 24*b* in a setup condition. An eleventh web panel 44*b* is hingedly connected to the second major corner panel 24*b* by a hinged connection in the form of a fold line 49*b*. A twelfth web panel 46*b* is hingedly connected to the eleventh web panel 44*b* by a hinged connection in the form of a fold line 51*b*. The twelfth web panel 46*b* is hingedly connected to the second side panel 18 by a hinged connection in the form of a fold line 53*b*.

The fold line 49*b* is substantially collinear with the fold line 17.

Each of the sixth pair of web panels 44*b*, 46*b* is defined in part by a pair of divergently arranged fold lines 49*b*/51*b*, 51*b*/53*b*.

The blank 10 comprises a sixth aperture A6 struck from the sixth pair of web panels 44*b*, 46*b* so as to interrupt the fold lines 49*b*, 51*b*, 53*b*. The sixth aperture A6 is located at a position at which the fold lines 49*b*, 51*b*, 53*b* would intersect with each other and with the fold lines 17 and 23*b*.

The third major corner panel 30*a* is hingedly connected to the second side panel 18 by a seventh pair of web panels 48*a*, 50*a*, also referred to herein as minor corner panels. The seventh pair of web panels 48*a*, 50*a* is hinged to a third bevelled or chamfered corner of the second side panel 18. The seventh pair of web panels 48*a*, 50*a* underlies the third major corner panel 30*a* in a setup condition. A thirteenth web panel 48*a* is hingedly connected to the second side panel 18 by a hinged connection in the form of a fold line 55*a*. A fourteenth web panel 50*a* is hingedly connected to the thirteenth web panel 48*a* by a hinged connection in the form of a fold line 57*a*. The fourteenth web panel 50*a* is hingedly connected to the third major corner panel 30*a* by a hinged connection in the form of a fold line 59*a*.

The fold line 59*a* is substantially collinear with the fold line 19.

Each of the seventh pair of web panels 48*a*, 50*a* is defined in part by a pair of divergently arranged fold lines 55*a*/57*a*, 57*a*/59*a*.

The blank 10 comprises a seventh aperture A7 struck from the seventh pair of web panels 48*a*, 50*a* so as to interrupt the fold lines 55*a*, 57*a*, 59*a*. The seventh aperture A7 is located at a position at which the fold lines 55*a*, 57*a*, 59*a* would intersect with each other and with the fold lines 19 and 31*a*.

The fourth major corner panel 30*b* is hingedly connected to the second side panel 18 by an eighth pair of web panels 48*b*, 50*b*, also referred to herein as minor corner panels. The eighth pair of web panels 48*b*, 50*b* is hinged to a fourth bevelled or chamfered corner of the second side panel 18. The eighth pair of web panels 48*b*, 50*b* underlies the fourth major corner panel 30*b* in a setup condition. A fifteenth web panel 48*b* is hingedly connected to the second side panel 18 by a hinged connection in the form of a fold line 55*b*. A sixteenth web panel 50*b* is hingedly connected to the fifteenth web panel 48*b* by a hinged connection in the form of a fold line 57*b*. The sixteenth web panel 50*b* is hingedly connected to the fourth major corner panel 30*b* by a hinged connection in the form of a fold line 59*b*.

The fold line 59*b* is substantially collinear with the fold line 19.

Each of the eighth pair of web panels 48*b*, 50*b* is defined in part by a pair of divergently arranged fold lines 55*b*/57*b*, 57*b*/59*b*.

The blank 10 comprises an eighth aperture A8 struck from the eighth pair of web panels 48*b*, 50*b* so as to interrupt the fold lines 55*b*, 57*b*, 59*b*. The eighth aperture A8 is located at a position at which the fold lines 55*b*, 57*b*, 59*b* would intersect with each other and with the fold lines 19 and 31*b*.

The blank 10 may comprise a handle structure H. The handle structure H may be provided at least in part in the top panel 16. The handle structure H comprises a handle opening or slot defined in the top panel 16. The handle opening may be defined at least in part by a first handle tab 60*a*. The first handle tab 60*a* is struck from the top panel 16 and is hinged connected thereto by a hinged connection in the form of a fold line 61*a*. The handle opening may be defined at least in part by a second handle tab 60*b*. The second handle tab 60*b* is struck from the top panel 16 and is hinged connected thereto by a hinged connection in the form of a fold line 61*b*. The second handle tab 60*b* is hinged in opposition to the first handle tab 60*a*. The second handle tab 60*b* is separated from, or severable from, the first handle tab 60*a* by a common cut line or severance line 63.

The handle structure H may extend into the adjacent panels, for example into the first side panel 14 and the second side panel 18. The severance line 63 may extend into each of the base and top panels 14, 18, a first severance line extension 63*a* may be provided in the first side panel 14. A second severance line extension 63*b* may be provided in the second side panel 18. The handle structure H comprises a relief structure, the relief structure may redirect or distribute load forces in the handle structure through the carton and or onto the contents (articles B) in the carton.

The relief structure comprises a cutline extending from the end of the first and second severance line extensions 63*a*, 63*b*. Each cutline is divergently arranged with respect to the first and second severance line extensions 63*a*, 63*b* from which it extends. The cut line may be 'V' or 'U' shaped. Each cut line is arranged so as to converge at the end of the first and second severance line extension 63*a*, 63*b*. The cutline and the respective first or second severance line extension 63*a*, 63*b* diverges from the respective first or second severance line extensions 63*a*, 63*b* towards the top panel 16.

The first side panel 14 comprises a pair of divergently arranged fold lines 65*a*, 65*b*, extending from the cutline extension 63*a* towards the top panel 16. The second side panel 14 comprises a pair of divergently arranged fold lines 67*a*, 67*b*, extending from the cutline extension 63*b* towards the top panel 16.

The blank 10 comprises an access device or dispenser D for gaining access to an interior of the carton 90 so as to be able to remove the carton contents.

The dispenser D comprises a detachable panel 70*a*/70*b*. A first portion 70*a* of the detachable panel 70*a*/70*b* is struck from the second side panel 18 and a second portion 70*b* of the detachable panel 70*a*/70*b* is struck from the base panel 20. The second portion of the detachable panel 70*b* is hingedly connected to the first portion 70*a* by a portion of the fold line 19.

The detachable panel 70*a*/70*b* is defined in part by a first severance line or tear line 71 provided in the second side panel 18. The detachable panel 70*a*/70*b* is defined in part by a second severance line or tear line 73*a*/73*b* provided in the base panel 20. The second tear line 73*a*/73*b* comprises a first part 73*a* and a second part 73*b*; the first part 73*a* is divergently arranged with respect to the second part 73*b*.

The first part 73*a* of the second tear line 73*a*/73*b* extends from a first location on the fold line 19 to a first end of a tear initiator 70*c* and the second part 73*b* of the second tear line 73*a*/73*b* extends from a second location on the fold line 19 to a second end of the tear initiator 70*c*.

The tear initiator comprises a foldable tab 70*c* hinged to the second portion 70*b* of the detachable panel 70*a*/70*b* by a fold line 75. The foldable tab 70*c* is defined in part by 'U' shaped or semi-circular cutline, although in other embodiments other shapes may be employed.

The detachable panel 70*a*/70*b* and tear initiator 70*c* define an opening, the opening takes the general form of an isosceles triangle, albeit with rounded corners or vertices. In other embodiments opening may take other forms for example but not limited to equilateral triangle, right-angled triangle, quadrilateral or other polygonal shapes.

The blank 10 may comprise at least one hinged connection in the form of a plurality of spaced apart partial depth cut lines 77*a*, 77*b*. In other embodiments, the hinged connection may be a score line, embossed or debossed line and defines a foldable region in the second side panel 18 proximate the first severance line 71. A portion of the hinged connection may be arranged to form a parallel curve or offset curve with respect to the first severance line 71. In the illustrated embodiment a pair of hinged connections are provided about curvilinear or arcuate portions of the first severance line 71. In this way the hinged connection is similarly shaped to portions of the first severance line 71.

The first and second parts 73*a*, 73*b* of the second tear line 73*a*/73*b* extend into the second side panel 18 so as to define continuous linear tear lines.

The first and second parts 73*a*, 73*b* of the second tear line 73*a*/73*b* define opposing side edges of the detachable or removable panel 70*a*/70*b* respectively.

The first part 73*a* of the second tear line 73*a*/73*b* is located closer to a first corner edge 55*a* of the second side panel 18 than the second part 73*b* of the second tear line 73*a*/73*b*. The first corner edge 55*a* of the second side panel 18 is defined by fold line 55*a* which hinges the thirteenth web panel 48*a* to the second side panel 18.

The first corner edge 55*a* extends obliquely with respect to the fold line 19 hinging the base panel 20 to the second side panel 18. An obtuse angle is defined between the first corner edge 55*a* and the fold line 19 between the base panel 20 and the second side panel 18.

A second corner edge 55*b* of the second side panel 18 is defined by fold line 55*b* which hinges the fifteenth web panel 48*b* to the second side panel 18. The second part 73*b* of the second tear line 73*a*/73*b* is located closer to the second corner edge 55*b* of the second side panel 18 than the first part 73*a* of the second tear line 73*a*/73*b*.

The second corner edge 55*b* extends obliquely with respect to the fold line 19 hinging the base panel 20 to the second side panel 18. An obtuse angle is defined between the second corner edge 55*b* and the fold line 19 between the base panel 20 and the second side panel 18.

FIG. 2 shows a notional line x-x' interposed between the first and second tear lines 73*a*, 73*b*. The notional line x-x' may substantially bisect the base panel 20 and the second side panel 18. The notional line x-x' is disposed at a right angle, perpendicularly, with respect to the first fold line 19.

A first acute angle $\alpha_1$ is defined between the notional line x-x' and the first corner edge 55*a*. A second acute angle $\alpha_2$ is defined between the notional line x-x' and at least part of the first tear line 73*b*. The first acute angle $\alpha_1$ is equal to or greater than the second acute angle $\alpha_2$.

A third acute angle $\beta_2$ is defined between the notional line x-x' and at least part of the second tear lines 73*b*. The first acute angle $\alpha_1$ is equal to or greater than the third acute angle $\beta_2$.

The second acute angle $\alpha_2$ is generally equal to the third acute angle $\beta_2$.

The first portion 70*b* of the detachable or removable panel 70*a*/70*b* is disposed between the first and second corner edges 55*a*, 55*b*.

A fourth acute angle $\beta_1$ is defined between the notional line x-x' and the second corner edge 55*b*. The fourth acute angle $\beta_1$ is equal to or greater than the third acute angle $\beta_2$.

Turning to the construction of the package as illustrated in FIG. 3, the article carrier 90 can be formed by a series of sequential folding operations. The folding process is not limited to that described below and may be altered according to particular manufacturing requirements.

The blank 10 is folded about fold line 15 such that the first side panel 14 is brought into overlying relationship with the top panel 16 and with part of the second side panel 18. The securing flap is brought into overlying relationship with the second side panel 18.

Glue or other adhesive treatment is applied to the securing flap 12 and to the first and second securing tabs 34*a*, 34*b*. In other embodiments the glue may be applied to corresponding regions of an inner surface of the base panel 20 and the third and fourth corner panels 30*a*, 30*b*.

The blank 10 is folded about fold line 19 such that the base panel 20 is brought into overlying relationship with the second side panel 18 and into face contacting relationship with the securing flap 12. A portion of each of the third and fourth corner panels 30*a*, 30*b* is brought into overlying relationship with the second side panel 18, the third and fourth corner panels 30*a*, 30*b* are brought into face contacting relationship with a respective one of the first and second securing tabs 34*a*, 34*b*.

The base panel 20 is secured to the securing flap 12. The third major corner panel 30*a* is secured to the first securing tab 34*a*. The fourth corner panel 30*b* is secured to the second securing tab 34*b*.

In this way the blank 10 is formed into a flat collapsed tubular structure which can be readily shipped or distributed to a convertor plant, at which the flat collapsed tubular structure may be erected into an open ended tubular structure and loaded with articles.

The flat collapsed tubular structure may be erected to form an open ended tubular structure by unfolding the top panel 16 with respect to the first side panel 14 such that the top panel 16 is disposed substantially perpendicularly with respect to the first side panel 14.

The carton 90, in its open ended tubular form, may be loaded with articles through one or both open ends thereof. It will be appreciated that in some embodiments one of the open ends of the carton 90 may be closed before loading the interior with articles through the remaining open end.

A first end of the tubular structure is closed by folding the first major corner panel 24*a*, about fold line 23*a*, with respect to the top panel 16. The fifth and sixth web panels 40*a*, 42*a* are folded internally into face to face relationship with each other. The ninth and tenth web panels 44*a*, 46*a* are folded internally into face to face relationship with each other.

The third major corner panel 30*a* is folded with respect to the base panel 20, about fold line 31*a*. The first securing tab 34*a* is folded, with respect to the securing flap 12, about fold line 35*a*. The thirteenth and fourteenth web panels 48*a*, 50*a* are folded internally into face to face relationship with each other. The first and second web panels 36*a*, 38*a* are folded internally into face to face relationship with each other.

The first top end closure panel 26*a* is folded with respect to the first major corner panel 24*a*, about fold line 25*a*. The first base end closure panel 32*a* is folded with respect to the third major corner panel 30*a*, about fold line 33*a*.

The first side end closure flap 22*a* is folded with respect to the first side panel 14, about fold line 21*a*.

Glue or other adhesive treatment is applied to the first side end closure flap 22*a*. In other embodiments the glue may be applied to a corresponding region of an inner surface of the second side end closure flap 28*a*.

The second side end closure flap 28*a* is folded with respect to the second side panel 18, about fold line 27*a*.

The second side end closure flap 28*a* is brought into overlapping relationship with the first side end closure flap 22*a*. The second side end closure flap 28*a* is brought into face to face contacting relationship with the first side end closure flap 22*a*. The second side end closure flap 28*a* is secured to the first side end closure flap 22*a*.

A second end of the tubular structure is closed by folding the second major corner panel 24*b*, about fold line 23*b*, with respect to the top panel 16. The seventh and eighth web panels 40*b*, 42*b* are folded internally into face to face relationship with each other. The eleventh and twelfth web panels 44*b*, 46*b* are folded internally into face to face relationship with each other.

The fourth major corner panel 30*b* is folded with respect to the base panel 20, about fold line 31*b*. The second securing tab 34*b* is folded with respect to the securing flap 12, about fold line 35*b*. The fifteenth and sixteenth web panels 48*b*, 50*b* are folded internally into face to face relationship with each other. The third and fourth web panels 36*b*, 38*b* are folded internally into face to face relationship with each other.

The second top end closure panel 26*b* is folded with respect to the second major corner panel 24*b*, about fold line 25*b*. The second base end closure panel 32*b* is folded with respect to the fourth major corner panel 30*b*, about fold line 33*b*.

The third side end closure flap 22*b* is folded with respect to the first side panel 14, about fold line 21*b*.

Glue or other adhesive treatment is applied to the third side end closure flap 22*b*. In other embodiments the glue may be applied to a corresponding region of an inner surface of the fourth side end closure flap 28*b*.

The fourth side end closure flap 28*b* is folded with respect to the second side panel 18, about fold line 27*b*.

The fourth side end closure flap 28*b* is brought into overlapping relationship with the third side end closure flap 22*b*. The fourth side end closure flap 28*b* is brought into face to face contacting relationship with the third side end closure flap 22*b*. The fourth side end closure flap 28*b* is secured to the third side end closure flap 22*b*.

FIG. 3 shows an assembled article carrier 90. The article carrier comprises a tubular structure defined by the plurality of main or primary panels 12, 14, 16, 18, 20.

FIG. 3B shows the article carrier 90 with the dispenser D in a deployed condition, the detachable panel 70*a*/70*b* has been removed to provide an opening O through which the carrier's contents can be removed. When the detachable panel 70*a*/70*b* is removed a plurality of articles B are exposed to view.

When the detachable panel 70*a*/70*b* is removed articles B in the inner columns C2, C3 are exposed to view. An article B in each of a lowermost tier of the inner columns C2, C3, is partially exposed to view, said articles are disposed in contact with the base wall 20 of the carton 90.

An article B1, B2 in each of a second tier of the inner columns C2, C3, is fully exposed to view, said articles are disposed in contact with one of the articles in the lowermost tier of the inner columns C2, C3.

An article B in each of a third tier of the inner columns C2, C3, is partially exposed to view, said articles are disposed in contact with one of the articles in the second tier of the inner columns C2, C3.

A lower article and a centre article B in each of the outer columns C1, C4 is partially exposed to view though the opening O.

The uppermost article B in each of the inner columns C2, C3 and the uppermost article B in each of the outer columns C1, C4 are concealed from view when the detachable panel 70*a*/70*b* is initially removed.

The fully exposed articles, first article B1 and second article B2, can be readily removed from the carton 90. Removal of one of the first and second articles B1, B2 allows the remaining articles to move generally downward consequently further articles B becoming readily removable through the opening.

Referring now to FIGS. 4 and 5 there is shown an alternative embodiment of the present disclosure. In the second illustrated embodiment, like numerals have, where possible, been used to denote like parts, albeit with the addition of the prefix "100" to indicate that these features belong to the second embodiment. The second embodiment shares many common features with the embodiment of FIGS. 1 to 3B, therefore only the differences from the embodiment illustrated in FIGS. 1 to 3B will be described in any greater detail.

FIG. 4 shows a blank 110 for forming an article carrier or carton 190 (see FIG. 5) according to the second embodiment. The blank 110 comprises a plurality of primary panels 112, 114, 116, 118, 120 for forming a tubular structure. The plurality of main panels 112, 114, 116, 118, 120 comprises; a securing flap 112, a first side panel 114, a top panel 116, a second side panel 118, and a base panel 120. The plurality of main panels 112, 114, 116, 118, 120 may be hingedly connected to each other, one to the next, in a linear series by a respective one of a plurality of hinged connections in the form of fold lines 113, 115, 117, 119.

The blank 110 comprises an access device or dispenser D for gaining access to an interior of the carton 190 so as to be able to remove the carton contents.

The dispenser D comprises a detachable panel 170*a*/170*b*.

A first portion 170*a* of the detachable panel 170*a*/170*b* is struck from the second side panel 118 and a second portion 170*b* of the detachable panel 170*a*/170*b* is struck from the base panel 120. The second portion of the detachable panel 170*b* is hingedly connected to the first portion 170*a* by the fold line 119.

The detachable panel 170*a*/170*b* is defined in part by a first severance line or tear line 171 provided in the second side panel 118. The detachable panel 170*a*/170*b* is defined in part by a second severance line or tear line 173*a*/173*b* provided in the base panel 120. The second tear line 173*a*/

173*b* comprises a first part 173*a* and a second part 173*b*; the first part 173*a* is divergently arranged with respect to the second part 173*b*.

The detachable panel 170*a*/170*b* and a tear initiator 170*c* define an opening, the opening takes the general form of a scalene triangle, albeit with rounded corners or vertices. In the illustrated embodiment the opening takes the general form of an acute triangle. In other embodiments opening may take other forms such as but not limited to obtuse triangle, right-angled triangle or other generally polygonal shape. In this embodiment the detachable panel 170*a*/170*b* is asymmetric.

The first part 173*a* of the second tear line 173*a*/173*b* extends from a first location on the fold line 119 to a first end of a tear initiator 170*c* and a second part 173*b* of the second tear line 173*a*/173*b* extends from a second location on the fold line 119 to a second end of the tear initiator 170*c*.

The first tear line 171 is at least substantially continuous or contiguous with first and second parts 173*a*, 173*b* of the second severance line 173*a*/173*b*.

The tear initiator comprises a foldable tab 170*c* hinged to the second portion 170*b* of the detachable panel 170*a*/170*b* by a fold line 175. The foldable tab 170*c* is defined in part by a cutline, the cutline may be 'U' shaped or semi-circular. Although in other embodiments other shapes may be employed. The cutline of the tear initiator 170*c* is continuous or contiguous with first and second parts 173*a*, 173*b* of the second severance line 173*a*/173*b*; in this way a continuous, closed, loop is formed.

When the detachable panel 170*a*/170*b* and tear initiator 170*c* are removed, articles B in the lowermost row R1 are exposed to view. A central article B3 in the lowermost row R1 is fully exposed to view. Articles in the lowermost row R1 adjacent to the central article B3 are partially exposed to view.

Each of a centrally disposed pair of articles B1, B2 in the second or middle row R2 is fully exposed to view, said articles B1, B2 are disposed in contact with, at least, the central article B3 in the lowermost row R1.

The articles B in the third or uppermost row R3 are substantially concealed from view when the detachable panel 170*a*/170*b* and tear initiator 170*c* are initially removed.

The fully exposed articles (first article B1, second article B2 and third article B3) can be readily removed from the carton 190.

Removal of any one of the first, second and third articles B1, B2, B3 will not affect the position of the remaining articles B. Due to the nested arrangement, the other articles B will be held in their initial positon.

Removal of another one of the first, second and third articles B1, B2, B3 will release the group of articles B within the carton 190 such that the remaining articles in the carton 190 cascade generally downward, towards the base panel 120. This movement of the articles B will allow removal of further articles B through the opening in the second side wall 118 created by removal of the detachable panel 170*a*/170*b* and tear initiator 170*c*.

Referring now to FIGS. 6 to 8B there is shown an alternative embodiment of the present disclosure. In the third illustrated embodiment, like numerals have, where possible, been used to denote like parts, albeit with the addition of the prefix "200" to indicate that these features belong to the third embodiment. The third embodiment shares many common features with the embodiments of FIGS. 1 to 5, therefore only the differences from the embodiments illustrated in FIGS. 1 to 5 will be described in any greater detail.

FIG. 6 shows a blank 210 for forming an article carrier or carton 290 (see FIG. 7) according to a third embodiment. The blank 210 comprises a plurality of primary panels 212, 214, 216, 218, 220 for forming a tubular structure. The plurality of main panels 212, 214, 216, 218, 220 comprises a securing flap 212, a first side panel 214, a top panel 216, a second side panel 218, and a base panel 220. The plurality of main panels 212, 214, 216, 218, 220 may be hingedly connected to each other, one to the next, in a linear series by a respective one of a plurality of hinged connections in the form of fold lines 213, 215, 217, 219.

The blank 210 may comprise a handle structure H. The handle structure H may be provided at least in part in the top panel 216. The handle structure H comprises a handle opening or slot defined in the top panel 216. The handle opening may be defined at least in part by a first handle tab 260*a*. The first handle tab 260*a* is struck from the top panel 216 and is hinged connected thereto by a hinged connection in the form of a fold line 261*a*. The handle opening may be defined at least in part by a second handle tab 260*b*. The second handle tab 260*b* is struck from the top panel 216 and is hingedly connected thereto by a hinged connection in the form of a fold line 261*b*. The second handle tab 260*b* is hinged in opposition to the first handle tab 260*a*. The second handle tab 260*b* is separate from, or severable from the first handle tab 260*a* by a common cut line or severance line 269.

A line of separation 269 defines the centre of the slot-type carrying handle H. The line of separation 269 is spaced a longitudinal distance from first and second ends of the top panel 16 (defined by fold lines 223*a*, 223*b* respectively). The line of separation 269 is located so as to be disposed off-centre with respect to the first and second ends of the top panel 216. Optionally, in other embodiments, the slot-type carrying handle H may be disposed in an at least substantially central position. The line of separation 269 is positioned such that when the blank 210 is formed into a carton 290 the line of separation 269 is located above a gap or void between two adjacent articles B.

The line of separation 269 extends into each of the adjacent first and second side panels 214, 218. In other embodiments, the slot-type carrying handle H may extend into only one of the adjacent first and second side panels 214, 218. The line of separation 269 is optionally a perforate cut line comprising one or more or a series of connecting nick portions. Optionally six connecting nick portions are provided in the top panel 216 along the line of separation 269; one nick portion is provided along the portion of the line of the separation 269 in the first side panel 214; and one nick portion is provided along the portion of the line of the line of separation 269 in the second side panel 218.

Spaced either side of the line of separation 269 and within the top panel 216 a pair of fold lines 261*a*, 261*b* define each of the lifting edges of the slot-type carrying handle H. Between fold line 261*a* and line of separation 269 a cushioning flap 260*a* is formed, likewise, between fold line 261*a* and line of separation 269 a cushioning flap 260*b* is formed. The width of the cushioning flaps may be controlled such that when folded beneath the plane of the top panel 216, the cushioning flaps can fold within the gap between the top panel 216 and two adjacently located articles B and at least partially underneath the top panel 216.

At each end of each cushioning flap 260*a*, 260*b* pairs of gussets are formed by crossed fold lines. Optionally the fold lines are disposed at least substantially at 90° relative to one another.

At each end of the slot-type carrying handle H a stress relief mechanism is provided which is tailored and configured to mitigate against stress build up or localised stress points in the carton 290 when the carton 290 is carried by the slot-type carrying handle H, in either direction (i.e. by using edge 261*a* or 261*b*).

The stress relief mechanisms (also referred to as relief cuts) are identical and therefore only one will be described, it being understood that the details provided regarding one end of the slot-type carrying handle H are also true in respect of the other end of the slot-type carrying handle H.

An optional curvilinear crease-cut line 265*b* extends from the intersection of fold lines 261*b* and 217. The curvilinear crease-cut line 265*b* may be formed as a crease along a first linear aspect and then optionally a full-depth cut line on a second curved aspect. The cut line portion of crease-cut line 265*b* may extend beyond the termination of line of separation 269 and in close proximity thereto. The cut line portion of crease-cut line 265*b* may terminate with a substantially "J"-shaped or hook-shaped cut line 267*b*. The cut line portion of crease-cut line 265*b* and the line of separation 269 define a first foldable tab 264*b*.

A linear crease line 265*a* extends from the cut line portion of crease-cut line 265*b* back toward the intersection between fold line 261*a* and fold line 217, to define a second foldable tab 264*a*.

The blank 210 comprises at least one access device or dispenser D1, D2 for gaining access to an interior of the carton 290 so as to be able to remove the carton contents. The illustrated embodiment comprises two access devices D1, D2. A first access device D1 is defined in the first side panel 214. A second access device D2 is defined in the second side panel 218. Each of the access device D1, D2 is substantially the same in construction and will be described in further detail by reference to the second access device D2.

The second access device D2 comprises a detachable panel 270*a*.

The detachable panel 270*a* is struck from the second side panel 218. The detachable panel 270*a* extends from the fold line 219 hinging the second side panel 218 to the base panel 220. The detachable panel 270*a* may be considered to interrupt the fold line 219.

The detachable panel 270*a* is defined in part by a first severance line or tear line 271 provided in the second side panel 218. The detachable panel 270*a* is defined in part by a second severance line or tear line 219*a*. The second severance line 219*a* is collinear and/or coextensive with the fold line 219. The second severance line 219*a* may be considered to interrupt the fold line 219.

The second access device D2 comprises a tear initiator 270*c*. The tear initiator 270*c* is struck from, or defined in, the second side panel 218. The tear initiator 270*c* comprises a tab 270*c* hingedly connected to the detachable panel 270*a* by a hinged connection in the form of a fold line 275.

The tab 270*c* may be positioned such that when the blank 210 is formed into a carton 290 the tab 270*c* is located adjacent a gap or void between two or more articles, for example, but not limited to, the gap may be located between two adjacent articles B in an uppermost inner row R3 and two adjacent articles B in an lowermost inner row R2. Alternatively, the tab 270*c* may be located adjacent a gap or void between the second side wall 218 and an adjacent article B, an end of the article may be concave so as to provide said void.

When the detachable panel 270*a* and tear initiator 270*c* are removed an opening O is formed in the second side wall 218, see FIG. 8A. A first article B1 in the lowermost row R1 (also referred to as a first row R1) is fully exposed to view, the first article B1 may be centrally located within the lowermost row R1.

Each of the articles B in the lowermost row R1 disposed adjacent to the, fully exposed, first article B1 is partially exposed to view. One or both of said partially exposed articles B may be endmost articles of the lowermost row R1.

A second article B2 in the adjacent row, the lowermost inner row R2 (also referred to as a second row R2) is fully exposed to view, the second article B2 may be in touching contact with the first article B1 in the lowermost row R1 and with one of the articles B in the lowermost row R1 disposed adjacent to the first article B1.

Removal of the first article B1 from the carton 290 will not affect the position of the remaining articles. Due to the nested arrangement, the other articles will be held or stay in their initial positon.

However, removal of the second article B2 will release the group of articles within the carton 290 such that the remaining articles in the carton 290 cascade generally downward, towards the base panel 220. This movement of the articles B will allow removal of further articles B through the opening O in the second side wall 218 created by removal of the detachable panel 270*a* and tear initiator 270*c*.

It will be appreciated that the detachable panels of the first and second access devices D1, D2 may be removed such that opposed ends of the first and second articles B1, B2 are fully exposed to view. A user may then push one end of the first and second articles B1, B2 such that it protrudes or passes through the opening in the side wall 214, 218 opposing that from which it was engaged.

The first tear line 271 comprises a first linear portion and a second linear portion defining opposing side edges of the detachable or removable panel 270*a*. The first linear portion may be generally parallel to the second linear portion.

The first linear portion of the first tear line 271 is located closer to a first corner edge 255*a* of the second side panel 218 than the second linear portion of the first tear line 271. The first corner edge 255*a* of the second side panel 218 is defined by fold line 255*a* which hinges the thirteenth web panel 248*a* to the second side panel 218.

The first corner edge 255*a* extends obliquely with respect to the fold line 219 hinging the base panel 220 to the second side panel 218. An obtuse angle is defined between the first corner edge 255*a* and the fold line 219 between the base panel 220 and the second side panel 218.

A second corner edge 255*b* of the second side panel 218 is defined by fold line 255*b* which hinges the fifteenth web panel 248*b* to the second side panel 218. The second linear portion of the first tear line 271 is located closer to the second corner edge 255*b* of the second side panel 218 than the first linear portion of the first tear line 271.

The second corner edge 255*b* extends obliquely with respect to the fold line 219 hinging the base panel 220 to the second side panel 218. An obtuse angle is defined between the second corner edge 255*b* and the fold line 219 between the base panel 220 and the second side panel 218.

FIG. 6 shows a first notional line x-x' interposed between the first linear portion of the first tear line 271 and the second linear portion of the first tear line 271. The first notional line x-x' may substantially bisect the base panel 220 and the second side panel 218. The first notional line x-x' is disposed at a right angle (perpendicularly) with respect to the first fold line 219.

A fifth acute angle $\alpha_4$ is defined between the notional line x-x' and the first linear portion of the first tear line 271.

A second notional line y-y' extends between a centre of the end of the first article B1 and a centre of the end of the second article B2. A sixth angle $\alpha_3$ is defined between the second notional line y-y' and the first notional line x-x'.

The sixth angle $\alpha_3$ is generally equal to the fifth acute angle $\alpha_4$.

A seventh acute angle $\beta_4$ is defined between the notional line x-x' and the second linear portion of the first tear line 271. The seventh acute angle $\beta_4$ is equal to the fifth acute angle $\alpha_4$.

The detachable or removable panel 270*a* is disposed between the first and second corner edges 255*a*, 255*b*.

A first acute angle $\alpha_1$ is defined between the notional line x-x' and the first corner edge 255*a*.

A fourth acute angle $\beta_1$ is defined between the notional line x-x' and the second corner edge 255*b*. The fourth acute angle $\beta_1$ is equal to or greater than the fifth acute angle $\alpha_4$.

The fourth acute angle $\beta_1$ is equal to the first acute angle $\alpha_1$ in magnitude.

Referring now to FIG. 9 there is shown an alternative embodiment of the present disclosure. In the fourth illustrated embodiment, like numerals have, where possible, been used to denote like parts, albeit with the addition of the prefix "300" to indicate that these features belong to the fourth embodiment. The fourth embodiment shares many common features with the embodiments of FIGS. 1 to 8B, therefore only the differences from the embodiments illustrated in FIGS. 1 to 8B will be described in any greater detail.

FIG. 9 shows a blank 310 for forming an article carrier or carton (not shown) according to a fourth embodiment. The blank 310 comprises a plurality of primary panels 312, 314, 316, 318, 320 for forming a tubular structure. The plurality of main panels 312, 314, 316, 318, 320 comprises a securing flap 312, a first side panel 314, a top panel 316, a second side panel 318, and a base panel 320. The plurality of main panels 312, 314, 316, 318, 320 may be hingedly connected to each other, one to the next, in a linear series by a respective one of a plurality of hinged connections in the form of fold lines 313, 315, 317, 319.

The blank 310 comprises an access device or dispenser D for gaining access to an interior of the carton so as to be able to remove the carton contents.

The dispenser D comprises a detachable panel 370*a*/370*b*.

A first portion 370*a* of the detachable panel 370*a*/370*b* is struck from the second side panel 318 and a second portion 370*b* of the detachable panel 370*a*/370*b* is struck from the base panel 320. The second portion of the detachable panel 370*b* is hingedly connected to the first portion 370*a* by the fold line 319.

The detachable panel 370*a*/370*b* is defined in part by a first severance line or tear line 371 provided in the second side panel 318. The detachable panel 370*a*/370*b* is defined in part by a second severance line or tear line 373*a*/373*b* provided in the base panel 320. The second tear line 373*a*/373*b* comprises a first part 373*a* and a second part 373*b*; the first part 373*a* is divergently arranged with respect to the second part 373*b*.

The first part 373*a* of the second tear line 373*a*/373*b* extends from a first location on the fold line 319 to a first end of a tear initiator 370*c* and a second part 373*b* of the second tear line 373*a*/373*b* extends from a second location on the fold line 319 to a second end of the tear initiator 370*c*.

The detachable panel 370*a*/370*b* and tear initiator 370*c* define an opening, the opening takes the general form of an inverted 'pear' shape. In other embodiments opening may take other forms such as but not limited to triangle or other generally polygonal shape.

The first tear line 371 is continuous or contiguous with first and second parts 373*a*, 373*b* of the second severance line 373*a*/373*b*.

The tear initiator 370*c* comprises a foldable tab 370*c* hinged to the second portion 370*b* of the detachable panel 370*a*/370*b* by a fold line 375. The foldable tab 370*c* is defined in part by a cutline, the cutline may be 'U' shaped or semi-circular cutline; although in other embodiments other shapes may be employed. The cutline of the tear initiator is continuous or contiguous with first and second parts 373*a*, 373*b* of the second severance line 373*a*/373*b*; in this way a continuous, closed, loop is formed.

When the detachable panel 370*a*/370*b* and tear initiator 370*c* are removed articles in the lowermost row R1 are exposed to view.

A central article B1 in the central row R2 is fully exposed to view. Each of the articles B in the central row R2 disposed adjacent then to central article B1 are partially exposed to view.

Each of the articles B in the third or uppermost row R3 are partially exposed to view when the detachable panel 370*a*/370*b* and tear initiator 370*c* are initially removed. Each of the articles B in the third or uppermost row R3 are disposed in contact with, at least, the central article B1 in the central row R2.

The fully exposed article B1 can be readily removed from the carton.

Subsequent articles B can then be removed through the opening in the second side wall 318 created by removal of the detachable panel 370*a*/370*b* and tear initiator 370*c*.

The present disclosure provides a package comprising a carton or article carrier 90; 190; 290 loaded with one or more articles B. The carton 90; 190; 290 comprises a plurality of main or primary panels defining an interior of the carton 90; 190; 290.

A carton comprises a first panel 18; 118; 218; 318 and a second, adjacent, panel 20; 120; 220; 320 hinged to the first panel 18; 118; 218; 318 along a first fold line 19; 119; 219; 319. The first panel 18; 118; 218; 318 has a first corner edge 55*a*; 255*a* extending obliquely with respect to the first fold line 19; 119; 219; 319 such that an obtuse angle is defined between the first corner edge 55*a*; 255*a* and the first fold line 19; 119; 219; 319. The carton 90; 190; 290 further comprises an opening feature D; D1, D2 which is at least partially removable from the carton 90; 190; 290. The opening feature D; D1, D2 comprises a removable panel 70*a*/70*b*; 170*a*/170*b*; 270*a*, 370*a*/370*b* defined at least in part by first and second tear lines 73*a*, 73*b*; 173*a*, 173*b*; 271; 373*a*, 373*b* which define opposing side edges of the removable panel 70*a*/70*b*; 170*a*/170*b*; 270*a*, 370*a*/370*b* respectively. The first and second tear lines each extending from the first fold line 19; 119; 219; 319 into the first panel 18; 118; 218; 318. The first tear line 73*a*; 173*a*; 373*a* is located closer to the first corner edge 55*a*; 255*a* than the second tear line 73*b*; 173*b*; 373*b*. A notional line x-x' is interposed between the first and second tear lines 73*a*, 73*b*; 173*a*, 173*b*; 271; 373*a*, 373*b* such that the notional line x-x' is disposed at a right angle with respect to the first fold line 19; 119; 219; 319. A first acute angle $\alpha_1$ is defined between the notional line x-x' and the first corner edge 55*a*; 255*a* and a second acute angle $\alpha_2$;

$\alpha_4$ is defined between the notional line x-x' and at least part of the first tear line 73*a*; 173*a*; 373*a*. The first acute angle $\alpha_1$ is equal to or greater than the second acute angle $\alpha_2$; $\alpha_4$.

A third acute angle $\beta_2$; $\beta_4$ is defined between the notional line x-x' and at least part of the second tear line 73*b*; 173*b*; 373*b*. The first acute angle $\alpha_1$ is equal to or greater than the third acute angle $\beta_2$; $\beta_4$.

The second acute angle $\alpha_2$; $\alpha_4$ is generally equal to the third acute angle $\beta_2$; $\beta_4$.

The first panel 18; 118; 218; 318 has a second corner edge 55*b*; 255*b* extending obliquely with respect to the first fold line 19; 119; 219; 319 such that an obtuse angle is defined between the second corner edge 55*b*; 255*b* and the first fold lines 19; 119; 219; 319. The removable panel 70*a*/70*b*; 170*a*/170*b*; 270*a*, 370*a*, 370*b* is disposed between the first and second corner edges 55*a*, 55*b*; 255*a*, 255*b*. A fourth acute angle $\beta_1$ is defined between the notional line x-x' and the second corner edge 55*b*; 255*b*. The fourth acute angle $\beta_1$ is equal to or greater than the third acute angle $\beta_2$; $\beta_4$.

Each of the first and second tear lines 73*a*, 73*b*; 173*a*, 173*b*; 271; 373*a*, 373*b* extends across the first fold line 19; 119; 219; 319 into the second panel 20; 120; 220; 320.

The opening feature D; D1, D2 further comprises a tear initiation feature 70*c*; 170*c*; 270*c*; 370*c* defined in the second panel 20; 120; 220; 320 (the second panel may be a side or end panel or a base panel). Each of the first and second tear lines 73*a*, 73*b*; 173*a*, 173*b*; 271; 373*a*, 373*b* extends from the tear initiation feature 70*c*; 170*c*; 270*c*; 370*c*.

In embodiments of the invention a carton 90; 190; 290 comprises a group of generally cylindrical articles B each having an end and a cylindrical axis. The group of articles B is received in an interior of the carton such that cylindrical axes of the articles extends generally perpendicularly to a plane of a first panel 18; 118; 218; 318. The group of articles B is arranged in a plurality of rows of articles B comprising a first row R1 and a second row R2. The first row R1 extends along a second panel 20; 120; 220; 320. The second row R2 is disposed along the first row R1 such that the articles B of the second row R2 are nested with the articles B of the first row R1.

A second notional line y-y' extends between a centre of the end of one of the articles in the first row and a centre of the end of an adjacent one of the articles in the second row. An angle $\alpha_3$ is defined between the second notional line y-y' and a first notional line x-x' is generally equal to a second acute angle $\alpha_4$. The angle $\alpha_3$ may be generally equal to the third acute angle $\beta_4$.

The present disclosure also provides a package comprising a carton or article carrier 90; 190; 290 loaded with one or more articles B. The carton 90; 190; 290 comprises a plurality of main or primary panels defining an interior of the carton 90; 190; 290. The carton comprises a first panel 18; 118; 218; 318 and a second, adjacent, panel 20; 120; 220; 320 hinged to the first panel 18; 118; 218; 318 along a first fold line 19; 119; 219; 319. The first panel 18; 118; 218; 318 has a first corner edge 55*a*; 255*a* extending obliquely with respect to the first fold line 19; 119; 219; 319 such that a first, obtuse, angle is defined between the first corner edge 55*a*; 255*a* and the first fold line 19; 119; 219; 319. The carton 90; 190; 290 further comprises an opening feature D; D1, D2 which is at least partially removable from the carton 90; 190; 290. The opening feature D; D1, D2 comprises a removable panel 70*a*/70*b*; 170*a*/170*b*; 270*a*, 370*a*, 370*b* defined at least in part by first and second tear lines 73*a*, 73*b*; 173*a*, 173*b*; 271; 373*a*, 373*b* which define opposing side edges of the removable panel 70*a*/70*b*; 170*a*/170*b*; 270*a*, 370*a*, 370*b* respectively. The first and second tear lines each extending from the first fold line 19; 119; 219; 319 into the first panel 18; 118; 218; 318. The first tear line 73*a*; 173*a*; 373*a* is located closer to the first corner edge 55*a*; 255*a* than the second tear line 73*b*; 173*b*; 373*b*. A notional line x-x' is interposed between the first and second tear lines 73*a*, 73*b*; 173*a*, 173*b*; 271; 373*a*, 373*b* such that the notional line x-x' is disposed at a right angle with respect to the first fold line 19; 119; 219; 319. A second, acute, angle is defined between the first notional line and at least part of the first tear line. The carton comprises a group of generally cylindrical articles each having an end and a cylindrical axis. The group of articles B is received in an interior of the carton such that cylindrical axes of the articles extends generally perpendicularly to a plane of the first panel 18; 118; 218; 318. The group of articles B is arranged in a plurality of rows of articles B comprising a first row R1 and a second row R2. The first row R1 extends along the second panel 20; 120; 220; 320. The second row R2 is disposed along the first row R1 such that the articles B of the second row R2 are nested with the articles B of the first row R1. A second notional line y-y' extends between a centre of the end of one of the articles in the first row and a centre of the end of an adjacent one of the articles in the second row. A third angle $\alpha_3$ is defined between the second notional line y-y' and a first notional line x-x' is generally equal to a second, acute, angle $\alpha_2$.

A fourth, acute, angle $\beta_4$ is defined between the notional line x-x' and at least part of the second tear line 73*b*; 173*b*; 373*b*. The third angle $\alpha_3$ is generally equal to a fourth, acute, angle $\beta_4$.

It can be appreciated that various changes may be made within the scope of the present invention. For example, the size and shape of the panels may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles, the carton comprising: a first panel and a second panel hinged to the first panel along a first fold line, the first panel having a first corner edge extending obliquely with respect to the first fold line such that an obtuse angle is defined between the first corner edge and the first fold line, the carton further comprising an opening feature which is at least partially removable from the carton, the opening feature comprising a removable panel defined at least in part by a first tear line and a second tear line which define opposing side edges of the removable panel respectively, the first and second tear lines each extending from the first fold line into the first panel, the first tear line being located closer to the first corner edge than the second tear line, wherein a first notional line is interposed between the first and second tear lines such that the first notional line is disposed at a right angle with respect to each of the first fold line and a second fold line in the second panel, wherein a first acute angle is defined between the first notional line and the first corner edge, wherein a second acute angle is defined between the first notional line and at least part of the first tear line and wherein the first acute angle is equal to or greater than the second acute angle.

2. The carton of claim 1 wherein a third acute angle is defined between the first notional line and at least part of the second tear line and wherein the first acute angle is equal to or greater than the third acute angle.

3. The carton of claim 2 wherein the second acute angle is generally equal to the third acute angle.

4. The carton of claim 1 wherein the first panel has a second corner edge extending obliquely with respect to the first fold line such that an obtuse angle is defined between the second corner edge and the first fold line, the removable panel being disposed between the first and second corner edges, wherein a fourth acute angle is defined between the first notional line and the second corner edge, wherein a third acute angle is defined between the first notional line and at least part of the second tear line and wherein the fourth acute angle is equal to or greater than the third acute angle.

5. The carton of claim 1 wherein each of the first and second tear lines extends across the first fold line into the second panel.

6. The carton of claim 5 wherein the opening feature further comprises a tear initiation feature defined in the second panel and wherein the first and second tear lines each extends from the tear initiation feature.

7. The carton of claim 1 further comprising a group of generally cylindrical articles each having an end and a cylindrical axis, the group of articles being received in an interior of the carton such that cylindrical axes of the articles extend generally perpendicularly to a plane of the first panel, the group of articles being arranged in a plurality of rows of articles comprising a first row and a second row, the first row extending along the second panel, the second row being disposed along the first row such that the articles of the second row are nested with the articles of the first row, wherein a second notional line extends between a centre of the end of one of the articles in the first row and a centre of the end of an adjacent one of the articles in the second row and wherein a fifth angle defined between the second notional line and the first notional line is generally equal to the second acute angle.

8. The carton of claim 7 wherein the fifth angle is generally equal to the third acute angle.

9. The carton of claim 1 wherein the first corner edge extends obliquely into the first panel with respect to the first fold line.

10. The carton of claim 1 wherein a portion of the first tear line extends from a first location on the first fold line to a first end of a tear initiator in the second panel.

11. The carton of claim 10 wherein a portion of the second tear line extends from a second location on the first fold line to a second end of the tear initiator in the second panel.

12. The carton of claim 11 wherein the tear initiator comprises a foldable tab hinged to a portion of the removable panel by the second fold line in the second panel.

13. A carton for packaging one or more articles, the carton comprising: a plurality of main or primary panels defining an interior of the carton including a first panel and a second panel hinged to the first panel along a first fold line, the first panel having a first corner edge extending obliquely with respect to the first fold line such that a first, obtuse, angle is defined between the first corner edge and the first fold line, the carton comprising an opening feature which is at least partially removable from the carton, the opening feature comprising a removable panel defined at least in part by a first tear line and a second tear line which define opposing side edges of the removable panel respectively, the first and second tear lines each extending from the first fold line into the first panel, wherein the first tear line is located closer to the first corner edge than the second tear line, a first notional line is interposed between the first and second tear lines such that the first notional line is disposed at a right angle with respect to each of the first fold line and a second fold line in the second panel, a second, acute, angle is defined between the first notional line and at least part of the first tear line, the carton comprises a group of generally cylindrical articles each having an end and a cylindrical axis, the group of articles is received in an interior of the carton such that cylindrical axes of the articles extend generally perpendicularly to a plane of the first panel, the group of articles is arranged in a plurality of rows of articles comprising a first row and a second row, the first row extends along the second panel, the second row is disposed along the first row such that the articles of the second row are nested with the articles of the first row, a second notional line extends between a centre of the end of one of the articles in the first row and a centre of the end of an adjacent one of the articles in the second row, a third angle is defined between the second notional line and a first notional line, the third angle is generally equal to a second, acute, angle.

14. The carton of claim 13 wherein a fourth, acute, angle is defined between the first notional line and at least part of the second tear line, the third angle is generally equal to the fourth, acute, angle.

15. The carton of claim 13 wherein the first corner edge extends obliquely into the first panel with respect to the first fold line.

16. The carton of claim 13 wherein a portion of the first tear line extends from a first location on the first fold line to a first end of a tear initiator in the second panel and portion of the second tear line extends from a second location on the first fold line to a second end of the tear initiator in the second panel.

17. A blank for forming a carton, the blank comprising a plurality of primary panels for defining an interior of the carton, the plurality of primary panels comprising:

a first panel; and a second panel hinged to the first panel along a first fold line;

the first panel having a first corner edge extending obliquely with respect to the first fold line such that an obtuse angle is defined between the first corner edge and the first fold line, the blank further comprising:

an opening feature which is at least partially removable from a carton formed from the blank, the opening feature comprising:

a removable panel defined at least in part by a first tear line and a second tear line which define opposing side edges of the removable panel respectively, the first and second tear lines each extending from the first fold line into the first panel, the first tear line being located closer to the first corner edge than the second tear line;

wherein a first notional line is interposed between the first and second tear lines such that the first notional line is disposed at a right angle with respect to each of the first fold line and a second fold line in the second panel, wherein a first acute angle is defined between the first notional line and the first corner edge;

wherein a second acute angle is defined between the first notional line and at least part of the first tear line; and wherein the first acute angle is equal to or greater than the second acute angle.

18. The blank of claim 17 wherein the first corner edge extends obliquely into the first panel with respect to the first fold line.

19. The blank of claim 17 wherein a portion of the first tear line extends from a first location on the first fold line to a first end of a tear initiator in the second panel and portion of the second tear line extends from a second location on the first fold line to a second end of the tear initiator in the second panel.

* * * * *